US012304680B2

(12) United States Patent
Talda et al.

(10) Patent No.: US 12,304,680 B2
(45) Date of Patent: May 20, 2025

(54) SYSTEM AND METHOD FOR AUTOMATICALLY PACKAGING AN ITEM

(71) Applicant: IOW, LLC, Renton, WA (US)

(72) Inventors: Timothy Alan Talda, Renton, WA (US); John Michael Moran, West Linn, OR (US)

( * ) Notice: Subject to any disclaimer, the term of this patent is extended or adjusted under 35 U.S.C. 154(b) by 127 days.

(21) Appl. No.: 17/941,544

(22) Filed: Sep. 9, 2022

(65) Prior Publication Data

US 2023/0002096 A1 Jan. 5, 2023

Related U.S. Application Data

(63) Continuation-in-part of application No. 17/514,005, filed on Oct. 29, 2021, now Pat. No. 11,931,985.
(Continued)

(51) Int. Cl.
*B65B 57/12* (2006.01)
*B65B 11/48* (2006.01)
(Continued)

(52) U.S. Cl.
CPC ..... *B65B 57/12* (2013.01); *B65B 11/48* (2013.01); *B65B 35/24* (2013.01); *B65B 41/12* (2013.01);
(Continued)

(58) Field of Classification Search
CPC .. B31D 5/0065; B31D 5/0069; B31D 1/0031; B65B 2210/04; B65B 41/12;
(Continued)

(56) References Cited

U.S. PATENT DOCUMENTS 2,728,479 A 12/1955 Wheeler
4,236,652 A 12/1980 Beguhn
(Continued)

FOREIGN PATENT DOCUMENTS

WO 2019040624 2/2019
WO 2022098599 5/2022
WO WO-2022182691 A1 * 9/2022 ..... B65D 65/40

OTHER PUBLICATIONS

International Search Report, PCT/US21/57550, mailed Jan. 31, 2022, 10 pages.
(Continued)

*Primary Examiner* — Joshua G Kotis
(74) *Attorney, Agent, or Firm* — Sand, Sebolt & Wernow Co., LPA

(57) ABSTRACT

A system, apparatus, and method for automatically packaging one or more articles is disclosed. The system, apparatus, and method processes incoming articles having different and/or similar shapes and in random orientations for packaging. The system, apparatus, and method form shipping-ready customized packages, based, at least in part, on data associated with an individual article and gathered by a detecting device as the individual article moves along a first conveyor towards a packaging station of the system. The customized packages are configured to conform to each individual article's shape and size. The packaging preferably is fully recyclable and is made from paper which is expandable to create a cushioning layer around the packaged article.

20 Claims, 21 Drawing Sheets

Related U.S. Application Data

(60) Provisional application No. 63/255,535, filed on Oct. 14, 2021, provisional application No. 63/261,297, filed on Sep. 17, 2021, provisional application No. 63/153,918, filed on Feb. 25, 2021, provisional application No. 63/111,544, filed on Nov. 9, 2020.

(51) Int. Cl.

| | |
|---|---|
| ***B65B 35/24*** | (2006.01) |
| ***B65B 41/12*** | (2006.01) |
| ***B65B 59/00*** | (2006.01) |
| ***B65B 61/06*** | (2006.01) |
| ***B65B 61/20*** | (2006.01) |

(52) U.S. Cl.
CPC ..... *B65B 59/001* (2019.05); *B65B 61/06* (2013.01); *B65B 61/20* (2013.01); *B65B 2210/04* (2013.01)

(58) Field of Classification Search
CPC ..... B65B 59/001; B65B 11/48; B65B 57/12; B65B 35/24; B65B 61/06; B65B 61/20
See application file for complete search history.

(56) References Cited

U.S. PATENT DOCUMENTS

| | | | | |
|---|---|---|---|---|
| 4,550,046 | A | 10/1985 | Miller | |
| 5,487,470 | A | 1/1996 | Pharo | |
| 5,544,473 | A | 8/1996 | Maida | |
| 5,688,578 | A | 11/1997 | Goodrich | |
| 5,910,138 | A | 6/1999 | Sperko et al. | |
| 6,996,951 | B2 | 2/2006 | Smith et al. | |
| 9,315,354 | B2 | 4/2016 | Tommasi | |
| 10,226,907 | B2 | 3/2019 | Goodrich | |
| 10,669,054 | B1 * | 6/2020 | Hoffman | B65B 59/003 |
| 10,773,839 | B1 * | 9/2020 | Talda | B65B 61/28 |
| 10,850,891 | B2 | 12/2020 | Yan | |
| 11,260,615 | B2 * | 3/2022 | Cheich | B65H 23/048 |
| 11,801,981 | B2 | 10/2023 | Wetsch | |
| 11,931,985 | B2 | 3/2024 | Talda | |
| 2003/0208988 | A1 * | 11/2003 | Buckley | B65B 61/02 53/411 |
| 2004/0040262 | A1 * | 3/2004 | Palumbo | B65B 59/001 53/504 |
| 2006/0169753 | A1 | 8/2006 | Piucci | |
| 2012/0222393 | A1 | 9/2012 | Vaccari | |
| 2015/0059290 | A1 * | 3/2015 | Ewert | B65B 35/16 53/64 |
| 2015/0239635 | A1 | 8/2015 | McDonald et al. | |
| 2016/0067938 | A1 | 3/2016 | Goodrich | |
| 2016/0159510 | A1 * | 6/2016 | Lau | B65B 57/06 53/64 |
| 2017/0203866 | A1 * | 7/2017 | Goodrich | B31D 5/0069 |
| 2018/0022493 | A1 * | 1/2018 | Lamb | B65B 59/00 700/103 |
| 2018/0086491 | A1 * | 3/2018 | Campbell | B65B 61/06 |
| 2018/0118397 | A1 * | 5/2018 | Blackford | B65B 61/26 |
| 2018/0141686 | A1 | 5/2018 | Christman et al. | |
| 2018/0273226 | A1 | 9/2018 | Lancaster, III et al. | |
| 2018/0346166 | A1 * | 12/2018 | Chang | B65B 5/108 |
| 2019/0062028 | A1 | 2/2019 | Getty et al. | |
| 2019/0100369 | A1 | 4/2019 | Hoffman et al. | |
| 2019/0276168 | A1 | 9/2019 | Gasparini et al. | |
| 2020/0198823 | A1 | 6/2020 | Bauer et al. | |
| 2020/0307866 | A1 | 10/2020 | Yan | |
| 2020/0331648 | A1 * | 10/2020 | Lees | B29C 66/43 |
| 2020/0346793 | A1 * | 11/2020 | Holmes | B65B 61/025 |
| 2020/0385154 | A1 * | 12/2020 | Campbell | B65B 57/00 |
| 2021/0253289 | A1 * | 8/2021 | Hirohashi | B65B 35/24 |
| 2022/0119181 | A1 * | 4/2022 | Goodrich | B65D 81/03 |
| 2022/0135308 | A1 | 5/2022 | Wetsch | |

OTHER PUBLICATIONS

International Search Report, PCT/US22/43666, mailed Jan. 3, 2023, 17 pages.
Examination Report Under Section 18(3), PCT/US21/57550, dated May 21, 2024, 13 pages.
Extended European Search Report, PCT/US21/57550, dated Sep. 9, 2024, 8 pages.
International Search Report, PCT/US2024/059537, mailed Feb. 19, 2025.
International Search Report, PCT/US2024/059547, mailed Feb. 19, 2025.

* cited by examiner

SYSTEM AND METHOD FOR AUTOMATICALLY PACKAGING AN ITEM

CROSS REFERENCE TO RELATED APPLICATIONS

This application claims the benefit of U.S. Provisional Patent Application Ser. No. 63/255,535 filed Oct. 14, 2021 and U.S. Provisional Patent Application Ser. No. 63/261,297 filed Sep. 17, 2021, the entire disclosures of which are incorporated herein by reference.

This application is also a Continuation-in-Part of U.S. patent application Ser. No. 17/514,005 filed Oct. 29, 2021, which claims the benefit of U.S. Provisional Patent Application Ser. No. 63/153,918 filed Feb. 25, 2021 and U.S. Provisional Patent Application Ser. No. 63/111,544 filed Nov. 9, 2020, the entire disclosures of which are incorporated herein by reference.

BACKGROUND

Technical Field

This disclosure is directed to an apparatus and a method of packaging articles. More particularly, this disclosure is directed to an apparatus and a method of packaging articles which are to be shipped from a packaging and shipping facility, such as a large conventional fulfillment center, in response to purchases made online Specifically, this disclosure is directed to an apparatus and a method of packaging articles in packaging materials which materials are produced in real time by an automated packaging system. In the method, the packaging material is customized to one or more parameters of each particular article to be shipped. The one or more parameters are identified by scanning each article as it moves along a conveyor system from a storage location to a shipping location within the facility. The customized packaging for any particular article is formed in real time.

Background Information

As the electronic commerce (ecommerce) industry continues to grow, so do the issues encountered by facilities, such as fulfillment centers, which are involved with packaging a large number of articles for shipment, particularly articles which are dissimilar in configuration. Typically packaging systems in such facilities utilize standard packaging, such as cardboard boxes or envelopes, for packaging and shipping articles. The standard packaging is pre-fabricated in standard sizes. Typically, articles which are ordered online are picked for shipping by pickers at a picking station who place the picked article into a bin. The bin is moved by conveyors from the picking station to a packaging station. At the packaging station, a packer is notified via a computer terminal of the most appropriately-sized packaging for that particular article. The packer selects that appropriately-sized packaging from an array of standard sizes of packaging, assembles the packaging, removes the picked article from the bin, places the article in the assembled packaging, seals the packaging, and then places the packaging with the article inside it onto another conveyor which transfers the packaged article to a shipping station for shipment. Robots are also being utilized in some facilities to package articles in custom-sized boxes. In other words, the robots select the most appropriately-sized box, will assemble the box, place the article to be shipped into the same, seal the box, and then send the packaged article to the shipping station for shipment to a customer.

The above-described situations can result in a relatively-small article being enclosed in a substantially much larger box, envelope, or other packaging than the article warrants. This occurs even though an algorithm informed the packer or the robot of the most-appropriately-sized box of the standard size boxes for use with respect to a particular article. Because the packaged article is surrounded by a lot of empty space, the article may become damaged during shipment unless filler materials are inserted into the box, envelope, or other package to surround the article. The unnecessarily larger packaging and the quantity of filler materials required to ship smaller articles is simply a waste of resources. The extra packaging also results in a larger than necessary volume of garbage being generated, even if that garbage is disposed of at locations remote from the packaging facility, i.e., at the end-customer's home or business. Shipping larger than necessary packaging takes up more space that necessary in shipping and delivery vehicles. This, in turn, requires that more shipping and delivery vehicles be utilized to deliver packages than would otherwise be needed if article-customized packaging was used instead of standard-sized packaging. Using larger than necessary packaging utilizes more space in each delivery vehicle than if article-customized packaging was used. Since more space is required in the vehicles to ship a fixed number of packages, more shipping and delivery vehicles are needed to deliver the fixed number of packages. This not only affects bottom lines but it is also bad for the environment to have an unnecessary number of vehicles leaving a carbon footprint.

In addition to the above-mentioned issues, many conventionally-used packaging systems utilize packaging materials comprised of more than one material. The packaging materials are typically not fully recyclable or are expensive to separate and recycle. This is also bad for the bottom line and may be bad for the environment.

SUMMARY

The present disclosure is directed to a system, apparatus, and method for forming article-size-appropriate packaging on demand and in real time. In one embodiment, the present disclosure is further directed to a system, apparatus, and method of forming packaging on material utilizing a fully recyclable packaging material. The fully recyclable packaging material is fabricated from a single type of material and therefore does not require separation into various streams during recycling operations. It will be understood that in other instances, the packaging material utilized in the system and apparatus may be only partially recyclable or is non-recyclable. The system, apparatus, and method disclosed herein therefore reduce overall costs for packaging dissimilar articles at a packaging and shipping facility, reduce storage space required at the facility to store large numbers of standard size boxes and packages, reduce the need for filler materials to be introduced into the packaging, and reduce the complexity of recycling the packaging once delivery of the article is completed.

A system, apparatus, and method for automatically packaging one or more articles is disclosed. The system, apparatus, and method processes incoming articles having different and/or similar shapes and in random orientations for packaging. The system, apparatus, and method form shipping-ready customized packages, based, at least in part, on data associated with an individual article and gathered by a detecting device as the individual article moves along a first conveyor towards a packaging station of the system. The customized packages are configured to conform to each individual article's shape and size. The packaging is expandable to create a cushioning layer around the packaged article. In one embodiment, the packaging material is fully recyclable.

In one aspect, an exemplary embodiment of the present disclosure may provide a system for custom packaging articles, said system comprising a Programmable Logic Controller (PLC) provided with programming to control automatic production of custom packaging; a packaging station; a detecting device operatively engaged with the PLC, said detecting device being operable to scan an individual article prior to the individual article being delivered to the packaging station; wherein the detecting device gathers data relating to the individual article during the scan and sends the gathered data to the PLC; wherein the programming determines a length of packaging material to be delivered to the packaging station based on the sent data; a former provided at the packaging station, said former being operatively engaged with the PLC and being actuated to form a package section from the expandable packaging material; wherein the individual article is delivered into the package section and is sealed therein to form a final package; and wherein the programming controls automatic production of the custom packaging from scanning the individual article through to sealing the final package.

In one embodiment, the system may further comprise a packaging material source operatively engaged with the PLC, wherein the packaging material source is actuated to deliver the length of packaging material to the packaging station. In one embodiment, the system may further comprise a first conveyor adapted to transport a plurality of articles, including the individual article, from a remote location to the packaging station. In one embodiment, the detecting device may have a field of view which encompasses a region of the first conveyor, and wherein the detecting device is adapted to scan the individual article when the individual article enters the field of view. In one embodiment, the system may further comprise a second conveyor adapted to transport the final package from the packaging station to a remote location for shipping to a consumer. In one embodiment, the PLC may be operatively engaged with one or both of the first conveyor and the second conveyor, and wherein the programming controls operation of the one or both of the first conveyor and the second conveyor.

In one embodiment, the PLC may include one or more processors, a computer readable storage medium and a communication interface; and wherein the communication interface is configured to be operatively connected to remote computing resources via a network. In one embodiment, the programming or software for controlling operation of the system and for controlling the method of forming a final package is uploaded to the one or more processors of the PLC or is installed on the remote computing resources.

In one embodiment, the system may further comprise a repositioning or reorienting device operatively engaged with the PLC, wherein the repositioning or reorienting device is operable to reposition or reorient the individual article prior to delivery of the individual article to the packaging station. In one embodiment, the system may further comprise a tensioning mechanism operatively engaged with the PLC, wherein the tensioning mechanism is selectively engageable with the packaging material delivered from the packaging material source, and wherein the tensioning mechanism is actuated to apply tension to the packaging material and to move the packaging material from an unexpanded condition to an expanded condition.

In one embodiment, the system may further comprise a labeling mechanism operatively engaged with the PLC, said labeling mechanism being operable to apply a shipping label with respect to the individual article to the packaging material. In one embodiment, the system may further comprise a sealing mechanism operatively engaged with the PLC, said sealing mechanism being operable in the packaging station to seal the package section and enclose the individual article therein to form the final package. In one embodiment, the system may further comprise a cutter operatively engaged with the PLC, said cutter being operable to cut the package section free from a remainder of the packaging material.

In one embodiment, the packaging material source may comprise pre-fabricated roll stock of the packaging material. In one embodiment, the packaging material source may comprise roll stock of a first layer of the packaging material; roll stock of a second layer of the packaging material, wherein the second layer differs from the first layer; and wherein an assembling and laminating mechanism may be operatively engaged with the PLC and be operable to receive therein and laminate part of the first layer and part of the second layer to one another in real time during a packaging operation, and to form, in situ, the packaging material which is subsequently delivered to the packaging station.

In one aspect, an exemplary embodiment of the present disclosure may provide an apparatus for custom packaging of articles, said apparatus comprising a packaging material source providing packaging material comprised of at least a first layer and a second layer, wherein the first layer is expandable in a horizontal plane and the second layer is expandable in a vertical plane as the first layer expands; a conveyor configured to convey one or more articles to be packaged; a detecting device configured to detect data associated with the one or more articles being conveyed along the conveyor; a controller in operable communication with the detecting device, the conveyor and the packaging material source; wherein the controller is configured to process the detected data associated with the one or more articles; a tensioning device configured to withdraw a length of packaging material from the packaging material source and apply tension thereto sufficient to cause the first layer and thereby the second layer of the length of packaging material to expand; a former in a packaging section of the apparatus, wherein the former is in operable communication with the controller and is configured to form a package section in the length of packaging material after the first layer and second layer have expanded; one or more sealing devices in operable communication with the controller and configured to seal at least one edge of the package section and thereby form a sealed package section; and a cutter in operable communication with the controller and configured to cut the sealed package section from a remainder of the packaging material.

In one aspect, an exemplary embodiment of the present disclosure may provide a method of custom packaging a plurality of articles, said method comprising providing a system for automatically custom packaging each individual article of the plurality of articles; feeding packaging material from a packaging material source of the system to a packaging station of the system; moving the plurality of articles along a first conveyor of the system and towards the packaging station; scanning an individual article of the plurality of articles with a detecting device of the system prior to the individual article reaching the packaging station; sending scanned data with respect to the individual article from the detecting device to a processor of the system; calculating, with programming provided to the processor, a length of the packaging material required to package the individual article; moving the packaging material from a unexpanded condition to an expanded condition to form expanded packaging material; forming, with a former of the system in the packaging station, a package section from the expanded packaging material; depositing the individual article into the package section; and sealing, with a sealing mechanism of the system, the package section around the individual article to form a final package.

In one embodiment, feeding the packaging material may include feeding pre-fabricated packaging material to the packaging station. In one embodiment feeding the packaging material includes assembling packaging material in situ by feeding a first layer of material and a second layer of material into an assembly and laminating mechanism during a packaging operation and assembling the first layer and the second layer into the packaging material which is subsequently fed to the packaging station. In one embodiment, one or both of the first layer and the second layer of material is fully recyclable. In one embodiment, moving the packaging material from the unexpanded condition to the expanded condition comprises applying tension to the packaging material. In one embodiment, the method may further comprise expanding a first layer of the packaging material in a horizontal plane in response to applying tension to the packaging material. In one embodiment, the method may further comprise expanding a second layer of the packaging material in a vertical plane in response to expanding the first layer in the horizontal plane.

In one embodiment, the method may further comprise cutting the final package from a remaining length of the packaging material moving towards the packaging station. In one embodiment, the method may further comprise repositioning or reorienting the individual article prior to the individual article reaching the packaging station. In one embodiment, the method may further comprise forming the final package in real time, wherein the real time is time taken for the individual article to travel along the first conveyor, be scanned by the detecting device, forming the package section in the packaging material, depositing the individual article into the formed package section, and sealing the package section.

BRIEF DESCRIPTION OF THE SEVERAL VIEWS OF THE DRAWINGS

Sample embodiments of the present disclosure are set forth in the following description, are shown in the drawings and are particularly and distinctly pointed out and set forth in the appended claims.

Similar numbers refer to similar parts throughout the drawings.

DETAILED DESCRIPTION

Figure 1A:
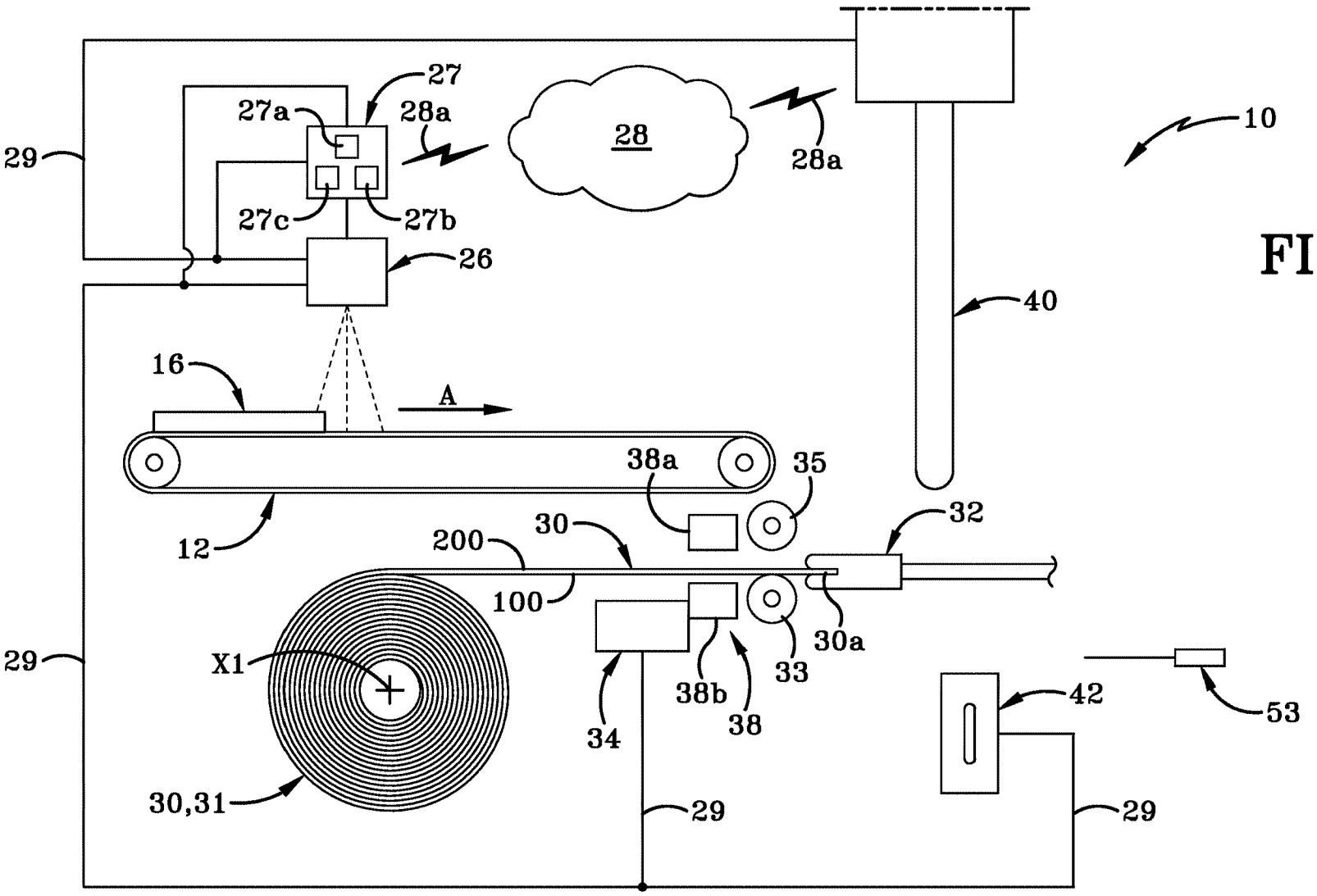
FIG. 1A is a diagrammatic side elevation view of a first embodiment of a system of packaging dissimilar articles in customized packages in accordance with the present disclosure, wherein the system utilizes feedstock in the form of packaging material pre-fabricated in accordance with the present disclosure.

Referring to FIGS. 1 through 12, there is shown a system 10 for automated packaging of differently shaped and sized articles in customized packaging for shipment to customers. In one embodiment, the packaging material utilized to produce the customized packaging is fully recyclable. In other embodiments, the packaging material utilized to produce the customized packaging is partially recyclable. In yet other embodiments, the packaging material utilized to produce the customized packaging is not recyclable.

In particular, the disclosed system 10 and method are useful for packaging a variety of dissimilar articles in settings such as online retail fulfillment centers and other packaging and shipping facilities. (It will be understood that the system 10 and method may also be used for packaging substantially identical articles, should that be desired.)

It should be noted that the figures do not necessarily represent the component parts of system 10 to scale. Additionally, many component parts of system 10 are not illustrated in the attached figures for clarify of illustration but a person of ordinary skill in the art will realize that these non-illustrated or omitted components are needed to actuate and operate system 10. For example, wiring and drive which power the various components may be only partially illustrated in the drawings or may be completely omitted from the drawings.

Figure 2A:
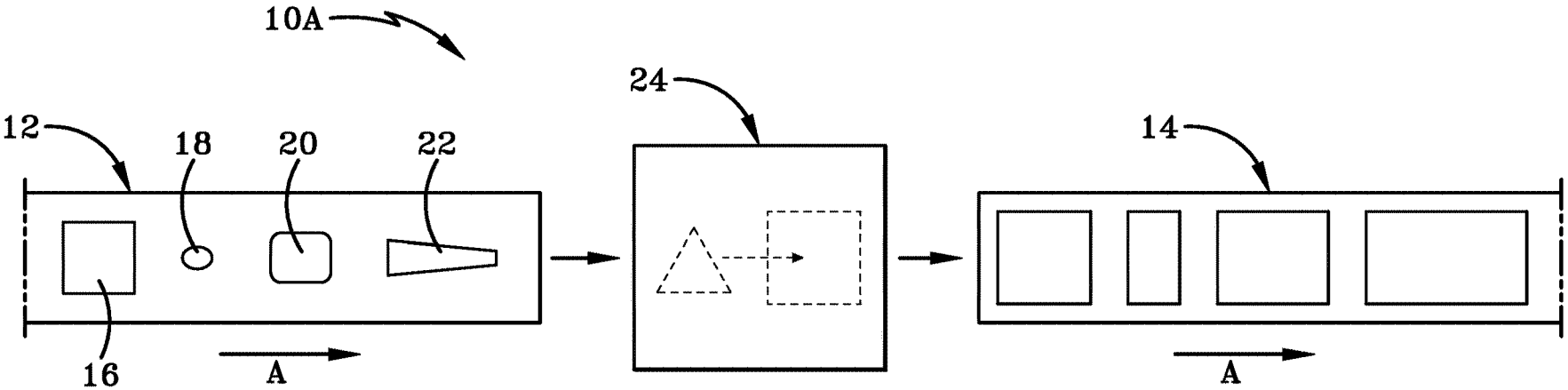
FIG. 2A is diagrammatic top plan view of a first configuration of part of the system shown in FIG. 1A, illustrating articles moving along a conveyor towards a packaging station, and showing a discharge conveyor or line moving packaged articles away from the packaging station.

FIG. 1A is a diagrammatic side elevation view of a first embodiment of a system in accordance with the present disclosure, generally indicated at 10. FIG. 2A shows a diagrammatic top plan view of part of system 10 plus an additional component not illustrated in FIG. 1A. System 10 includes a first conveyor 12 and a second conveyor 14 (FIG. 2A). First conveyor 12 is configured to move a plurality of differently shaped and sized articles 16, 18, 20, and 22 from a picking station (not shown) in the packaging and shipping facility towards a packaging station 24 (FIG. 2A) therein. Packaging station 24 may also be referred to as a "load zone". The movement of first conveyor 12 is in a first direction, as indicated by arrow "A". As will be later described herein and illustrated in the accompanying drawings, in the packaging station 24 the individual articles 16-22 will be enclosed in packaging which is customized as closely as reasonably possible to suit the three dimensional characteristics of that particular article. The packaging will be customized in real time to suit the dimensions and configuration of each individual article 16-22. Once the customized packaging is formed in real time and an individual article has been enclosed in its customized packaging, the packaged article is moved onto the second conveyor 14. The second conveyor 14 is a discharge conveyor of the system 10 which removes the packaged article in the direction "A" from the packaging station 24 towards a shipping station (not shown) of the facility. At the shipping station the packaged article is shipped out to a customer who ordered the article online. It will be understood that second conveyor 14 is illustrated in FIG. 2A as being aligned with first conveyor 12 such that movement towards the packaging station 24 and away from the packaging station is in the same direction "A". However, in other embodiments, second conveyor 14 may intersect the direction "A" and move the packaged article away from packaging station 24 at different direction from how the article was originally moved toward the packaging station 24. For example, if the second conveyor 14 is oriented at ninety degrees to first conveyor 12 then the direction of movement of the packaged article away from packing station 24 will be in a direction at ninety degrees to the direction "A".

Figure 5:
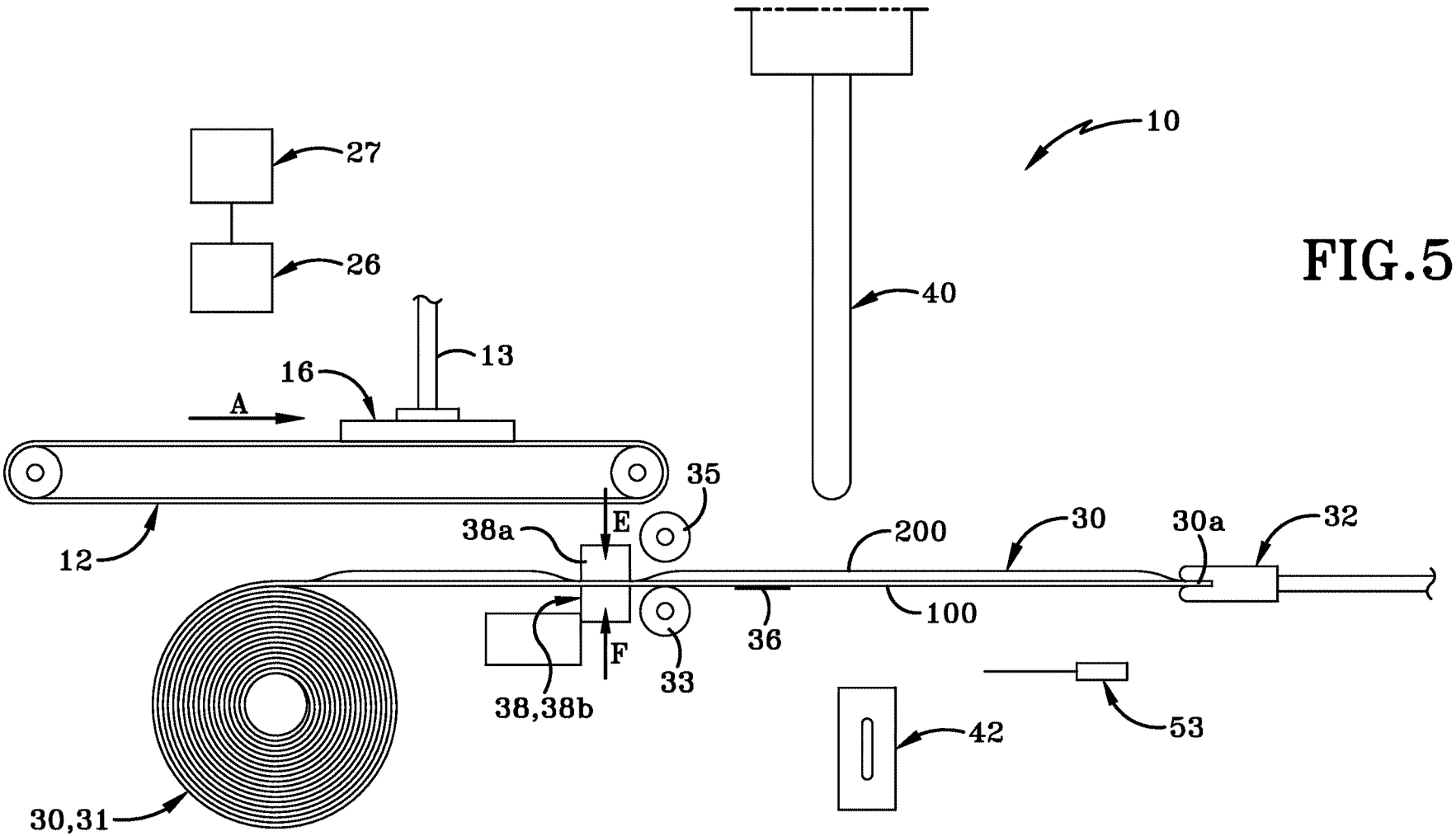
FIG. 5 is a diagrammatic side elevation view of the system of the present disclosure showing an exemplary repositioning or reorienting device adjusting a position and/or an orientation of the specific article on the conveyor and illustrating the sealing mechanism compressing a region of the selected length of the expanded packaging material and sealing the same.

It should be noted with respect to FIG. 2A that the articles 16-22 moving along first conveyor 12 are not only differently shaped and sized, but may also be placed at random different orientations on the first conveyor 12. The presently-disclosed system 10 and method do not require that the articles 16-22 be rearranged into a specifically-required orientation on first conveyor 12 in order to be packaged. However, a repositioning or reorienting device or mechanism may be utilized as part of system 10 to change the orientation of any particular article 16-22 on first conveyor 12 or to otherwise manipulate any article 16-22 on first conveyor 12 as needed. FIG. 5 shows an exemplary repositioning or reorienting device or mechanism in the form of a robotic arm 13 being used to adjust a position of article 16 on first conveyor 12. In other embodiments, a repositioning or reorienting device or mechanism may include, but is not limited to, a vibrating belt, static or actuating rods and rails, and/or a drop in elevation such as a step down. It will be understood that robotic arm 13 is only one way of orienting and/or manipulating articles 16-22 as needed, and any suitable way or mechanism may be utilized in system 10. In other embodiments, the orienting of the article 16-22 may be integrated to the system 10 or may be a stand-alone solution using its own logic and devices independent of the primary packaging machine 10. Vision devices and/or verification sensors or scanners (not shown) may also be provided in system 10 to confirm that the repositioning or reorienting device or mechanism 13 has successfully accomplished the needed change in orientation of the article 16-22. Some or all of the vision devices and/or verification sensors or scanners may be omitted in other embodiments.

Figure 1B:
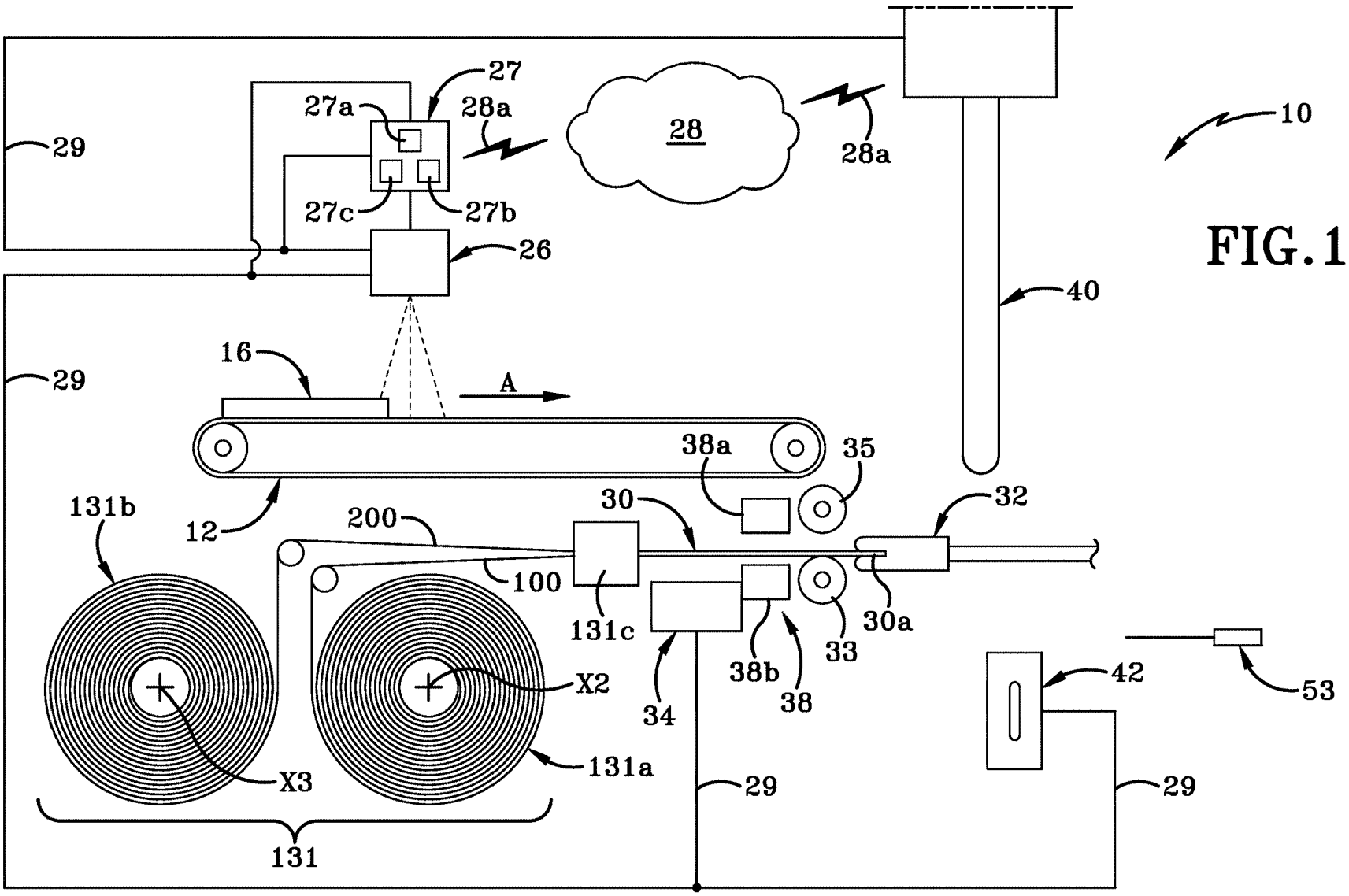
FIG. 1B is a diagrammatic side elevation view of a second embodiment of a system of packaging dissimilar articles in customized packages in accordance with the present disclosure, wherein the system utilizes feedstock in the form of packaging material in accordance with the present disclosure which is assembled on site during the packaging process.

System 10 further includes a detecting device 26 which is utilized to scan articles 16-22 as they move on first conveyor 12 in the direction "A". Detecting device 26 is shown in FIGS. 1A and 1B scanning an article 16 which has entered a field of view of the detecting device 26, where that field of view encompasses part of the first conveyor 12. (The articles 18, 20, and 22 are omitted from FIGS. 1A and 1B and from other figures for clarity of illustration.) Detecting device 26 provides detected data/information about the scanned article to a Programmable Logic Controller (PLC) 27 of the system 10. Detecting device 26 is operatively engaged with PLC 27 and is controlled thereby.

Detecting device 26 is utilized to measure one or more of a length, width, and height of article 16 and/or gather other pertinent information about the article 16 which will enable system 10 to form customized packaging which will most closely conform to the specific shape and size of article 16 to be correctly and adequately packaged by system 10. Additionally, detecting device 26 may provide information to the PLC 27 regarding the orientation of article 16-22 on first conveyor 12 so that the repositioning or reorienting mechanism 13 may be actuated by PLC 27. One suitable detecting device 26 suitable for use in system 10 is a COGNEX® In-sight Laser Profiler which is positioned proximate the first conveyor 12 and is operable to scan articles 16-22 moving therealong. (COGNEX® is a registered trademark of COGNEX CORPORATION of Natick Massachusetts). The COGNEX® detecting device 26, for example, is capable of taking around 20 measurements per minute.

PLC 27 includes a processor 27*a*, a computer-readable medium 27*b*, and a communication interface 27*c*. Processor 27*a* includes any suitable processing logic which interprets and executes instructions, such as, for example, one or more processors, microprocessors, or the like. The computer-readable medium 27*b* may be any suitable physical and/or logical memory device, such as, for example, a dynamic storage device, a static storage device, or the like.

Communication interface 27*c* may be any suitable communication interface allowing communication between the PLC 27, other components of the system 10, and remote computing resources 28 (FIG. 1A) such as a cloud computing environment, a fog computing environment, or the like via a network 28*a*. The network 28*a* may be any suitable network, such as, for example, a wired network (e.g., a bus network) and/or a wireless network (e.g., the Internet). Programming or software for controlling operation of system 10 and controlling the method of forming a final package is uploaded to the one or more processors of the PLC 27 or is installed on the remote computing resources.

Additionally, wiring 29 (only some of which is illustrated only in FIGS. 1A and 1B), operatively connects various components of system 10 to one another and to PLC 27. PLC 27 is programmed to operate the various components of system 10 and produce the customized packaging for the articles 16-22.

In accordance with an aspect of the present disclosure, a specially-configured packaging material 30 (FIG. 1A), in accordance with an aspect of the present disclosure, is utilized for packaging articles 16-22 in real time in the packaging station 24. FIG. 1A shows the specially-configured packaging material 30 is provided for use in system 10 as a pre-fabricated packaging material source 31. Packaging material source 31 not only includes the illustrated roll stock of packaging material 30 but also includes motors and other equipment for rotating roll stock 31 about axis X1. The equipment of packaging material source 31 is operatively engaged with PLC 27 and is controlled thereby. System 10 is fully automated to utilize the packaging material 30 drawn from the packaging material source 31. As illustrated, packaging material 30 is in the form of roll stock but in other applications (not illustrated herein) individual sheets of packaging material 30 may be utilized instead of the roll stock. It should be noted that the roll stock 30, 31 may unwind over the top as shown in FIG. 1A or unroll from the bottom (not shown).

In accordance with an aspect of the present disclosure, a specially-configured packaging material 30 (FIG. 1B), in accordance with an aspect of the present disclosure, is utilized for packaging articles 16-22 in real time in the packaging station 24. FIG. 1B shows a packaging material source 131 being operatively engaged into system 10. Packaging material source 131 includes two separate roll stocks 131*a*, 131*b* which are utilized to fabricate packaging material 30 as part of the packaging method. The individual sheet materials provided by roll stocks 131*a*, 131*b* are engaged with one another to form packaging material 30 by an assembly and laminating mechanism 131*c* as will be later described herein. System 10 is fully automated to utilize the packaging material 30 assembled in situ from the packaging material source 131. As illustrated, packaging material 30 is in the form of roll stock 131*a*, 131*b* but in other applications (not illustrated herein) individual sheets of the two sheet materials which form packaging material 30 may be utilized instead of the roll stock 131*a*, 131*b*. It should be noted that one or both of the roll stock 131*a*, 131*b* ay unwind over the top as shown in FIG. 1B or unroll from the bottom (not shown).

Packaging material 30 and is use in system 10 will be described in greater detail later herein.

Figure 2B:
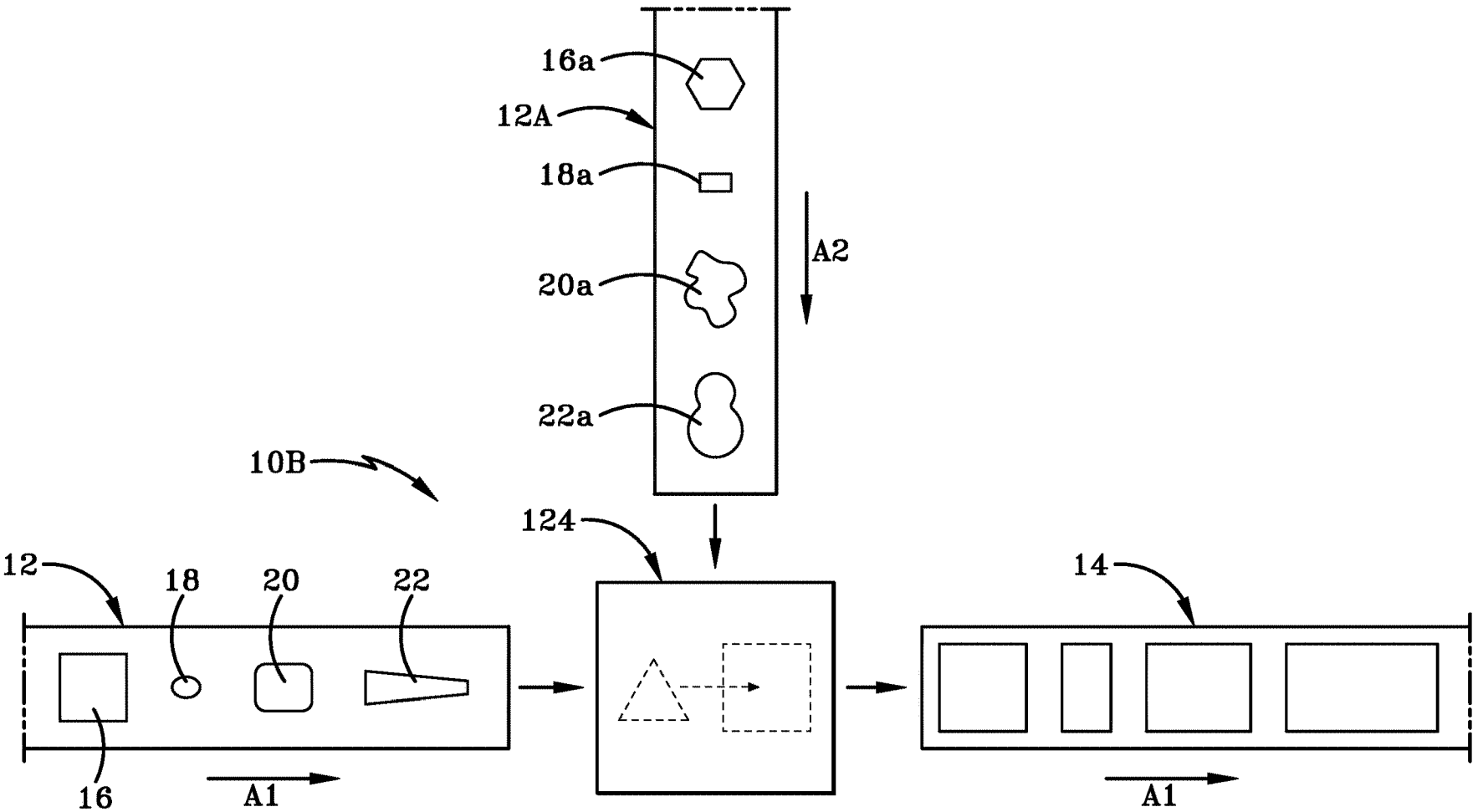
FIG. 2B is diagrammatic top plan view of a second configuration of part of the system of FIG. 1A, illustrating two conveyors moving articles to be packaged towards a packaging station, and showing a discharge conveyor or line moving packaged articles away from the packaging station.

FIG. 2B is diagrammatic top plan view of a second configuration of part of the system shown in FIG. 1A. This second configuration of the system is indicated by the reference character 10B. FIG. 2B shows two first conveyors 12 and 12A, moving articles to be packaged towards packaging station 124, and further shows a discharge conveyor or line 14 moving packaged articles away from the packaging station 124. First conveyors 12, 12A are illustrated as being oriented at ninety degrees to one another. First conveyor 12 is shown moving a plurality of differently shaped and sized articles 16, 18, 20, and 22 towards packaging station 124 in the direction "A1". First conveyor 12A is shown moving a second plurality of differently shaped and sized articles 16*a*, 18*a*, 20*a*, and 22*a* towards packaging station 124 in the direction indicated by arrow "A2". Each of the directions "A1" and "A2" is considered to be a "first direction" with respect to the associated first conveyor 12, 12A inasmuch as the movement of the articles 16-22 and 16*a*-22*a* is towards the packaging station 124.

It will be understood that FIG. 2B illustrates an exemplary arrangement only. In other embodiments, first conveyors 12, 12A may be arranged other than as illustrated in FIG. 2B. For example, first conveyors 12, 12A may not be arranged perpendicular to one another. The first conveyor 12 carrying the articles 16-22 may be arranged directly over roll stock 31 or at any other orientation within system 10B. The other first conveyor 12A just has to intersect the machine at packaging station 124. It will further be understood that more than two first conveyors may be utilized in system 10B to deliver articles to packaging station 124. Still further, it will be understood that additional first conveyors 12, additional packaging stations 124, and additional second conveyors or discharge conveyors 14 may be utilized in the system 10B in accordance with the present disclosure.

FIG. 2B shows that the articles 16-22 and 16*a*-22*a* being conveyed to the packaging station 124 either in-line with the particular first conveyor 12, 12A or at 90 degrees relative to the particular first conveyor 12, 12A which delivered the specific article to the packaging station 124. Second conveyor 14 is in-line with first conveyor 12 but is oriented at ninety degrees to first conveyor 12A.

Figure 2C:
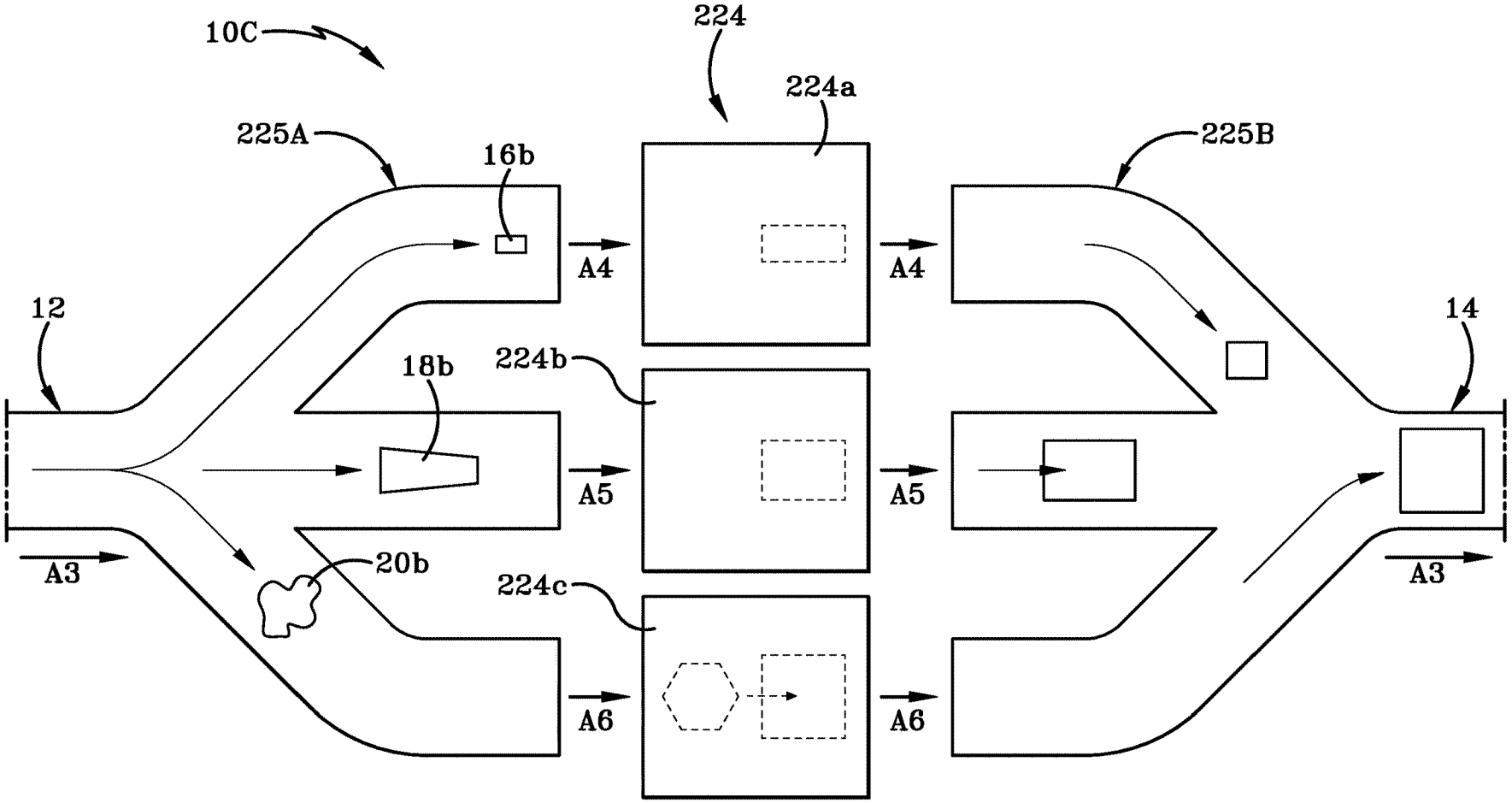
FIG. 2C is a diagrammatic top plan view of a third configuration of part of the system of FIG. 1A, illustrating a conveyor, a packaging station which includes multiple lines for forming customized packaging, multiple lines for moving packaged articles to a discharge conveyor or line, and which discharge conveyor moves the packaged articles away from the packaging station.

FIG. 2C shows a system 10C in which a first conveyor 12 delivers articles such as articles 16*c*, 18*c*, 20*c* to a packaging station 224 by moving those articles in a first direction "A". A second conveyor 14 removes packaged articles from the packaging station 224 and directs them to a shipping station (not shown) of the facility. In this particular instance, the packaging station 224 includes more than one packaging line in which articles may be packaged. As illustrated, packaging station 224 includes a first packaging line 224*a* for packaging smaller articles, a second packaging line 224*b* for packaging intermediate size articles, and a third packaging line 224*c* for packaging larger size articles. Although not illustrated herein, in this arrangement of system 10C each of the packaging lines 224*a*, 224*b*, 224*c* may be supplied with roll stock (such as roll stock 31 or 131) that is of a different width based on the dimensions of the articles to be packaged on the respective packaging line 224*a*, 224*b*, 224*c*. A first slide member 225A may be provided at the end of the first conveyor 12 to direct differently sized articles to the appropriate packaging line 224*a*, 224*b*, and 224*c*. A second slide member 225*b* may be interposed between the packaging lines 224*a*, 224*b*, 224*c*, and the second conveyor 14 to direct the packaged articles from the respective packaging lines 224*a*, 224*b*, and 224*c* onto a same discharge conveyor 14. In other instances, each of the packaging lines 224*a*, 224*b*, 224*c* may be provided with a dedicated discharge conveyor to move the packaged articles to the shipping station (not shown) of the packaging and shipping facility.

As has been briefly mentioned herein and as will be described in greater detail later hereafter, in any of the systems 10, 10A, 10B, 10C, in the packaging station the individual articles are packaged in customized packaging tailored to each specific individual article's dimensions and shape. In particular, the packaging will be customized in real time to suit the dimensions and configuration of each individual article. Once the customized packaging is formed in real time and an individual article has been enclosed in its customized packaging, the final package is moved onto a second conveyor 14 and is sent to a shipping station of subsequent shipping to a customer who ordered that specific article.

Systems 10, 10A, 10B, and 10C are designed modularly so that the configuration is easy, with commonly used parts for infeed and discharge. It should be noted that the packaging station 24, 124, 224 may be located at an elevation below the elevation of the first conveyor 12, 12A along which a particular article 16-22 and/or 16*a*-22*a* travels. This change in elevation between the first conveyor 12, 12A and the packaging station 24, 124, 224 is illustrated in FIG. 1A, for example.

FIGS. 3A, 3B, 3C, 3D, 3E, 3F, 3G, and 3H show an exemplary construction of the specially-configured packaging material 30 provided by packaging material source 31 or 131. The packaging material, the manufacture of the packaging material, and a system for packaging articles therewith are the subject of U.S. Provisional Patent Application Ser. No. 63/111,544, filed Nov. 9, 2020 entitled "Paper-Based Packaging System", U.S. Provisional Patent Application Ser. No. 63/153,918, filed Feb. 25, 2021 entitled "Packaging Material with Expanding Layer"; and U.S. application Ser. No. 17/514,005 filed Oct. 29, 2021 entitled "Packaging Material With Expanding Layer And Packaging Final package Formed Therewith". The entire disclosures of these three patent applications are incorporated herein by reference.

Before discussing the operation of system 10 in the real time packaging of article 16, the packaging material 30 will be discussed in some detail, reference being had to U.S. Provisional Patent Application Ser. No. 63/153,918 and U.S. patent application Ser. No. 17/514,005 referred to above. Packaging material 30 is comprised of one or more expandable layers which are preferably formed from materials that are entirely recyclable, such as paper. FIGS. 3A through 3H show packaging material 30 comprised of two layers 100, 200 that are adhered to one another. It should be understood, however, that additional layers may be utilized in packaging material 30.

Figure 3A:
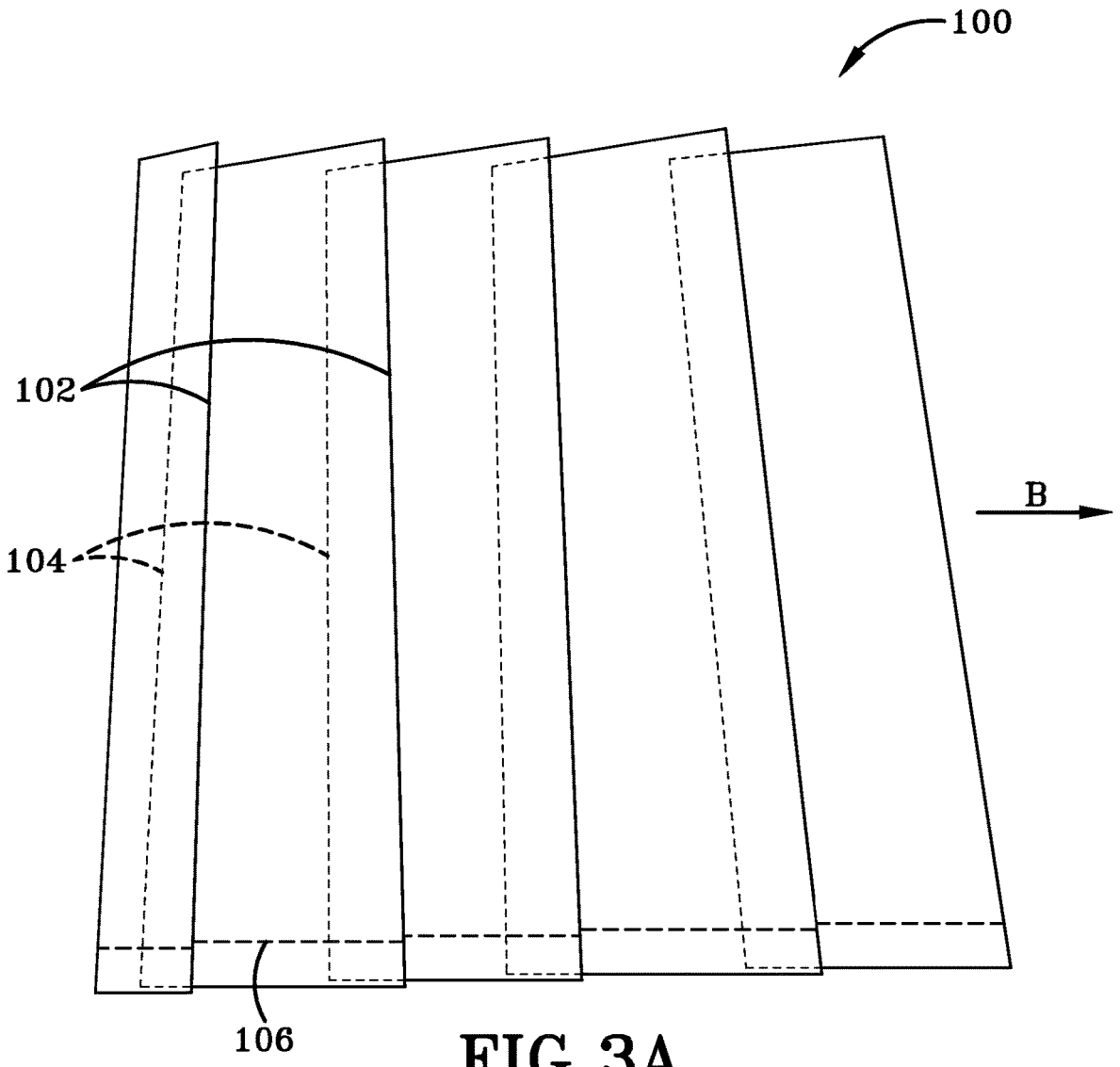
FIG. 3A is a top plan view of an expandable first layer of a length of packaging material utilized in the system of FIGS. 1A through 2C.
Figure 3B:
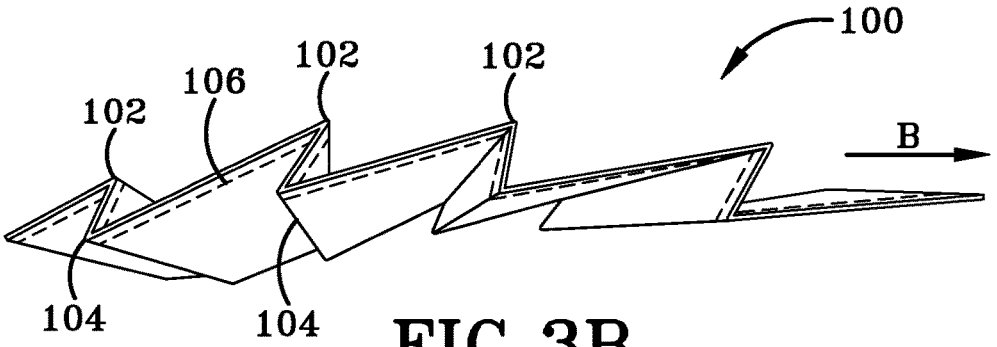
FIG. 3B is a side perspective view of the first layer of the length of packaging material of FIG. 3A showing how the first layer of the packaging material is capable of expanding in length.
Figure 3C:
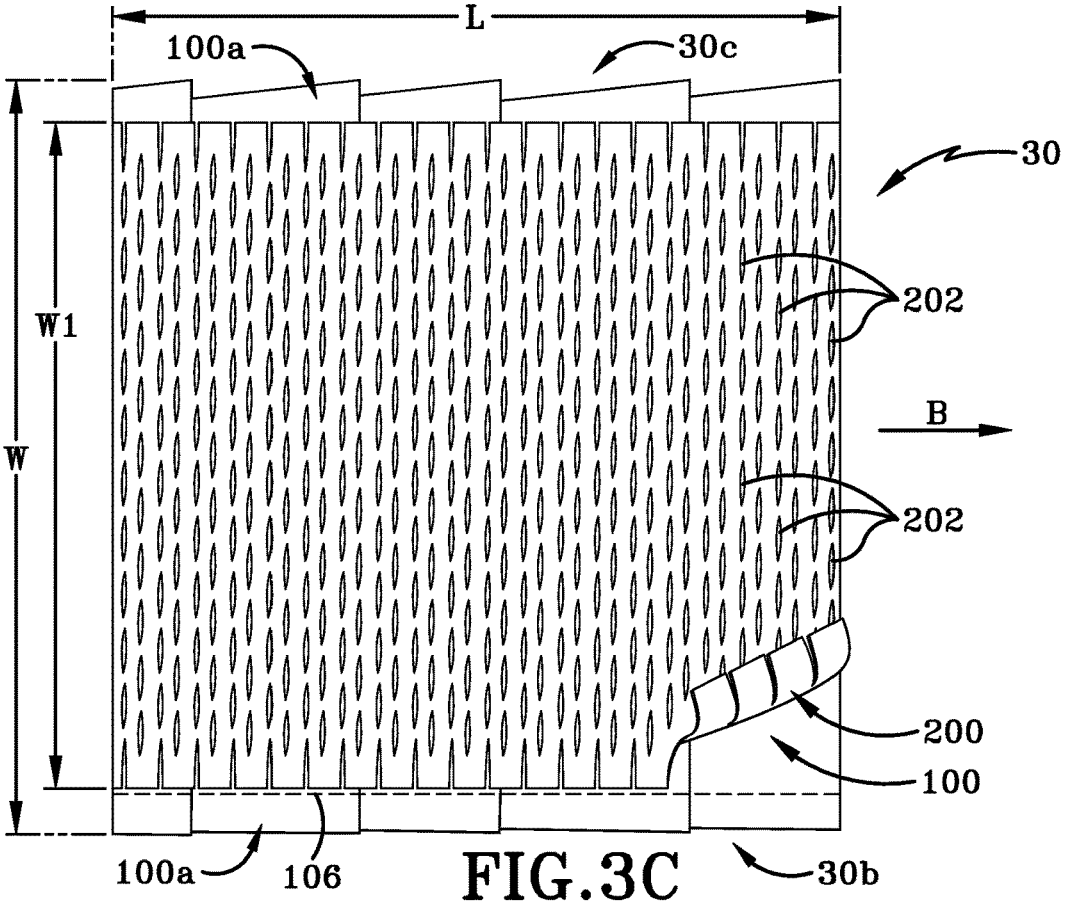
FIG. 3C is a top plan view of the length of the packaging material utilized in the system of FIG. 1A, where both the expandable first layer and an expandable second layer are illustrated, and both the first layer and second layer are in an unexpanded condition.
Figure 3D:
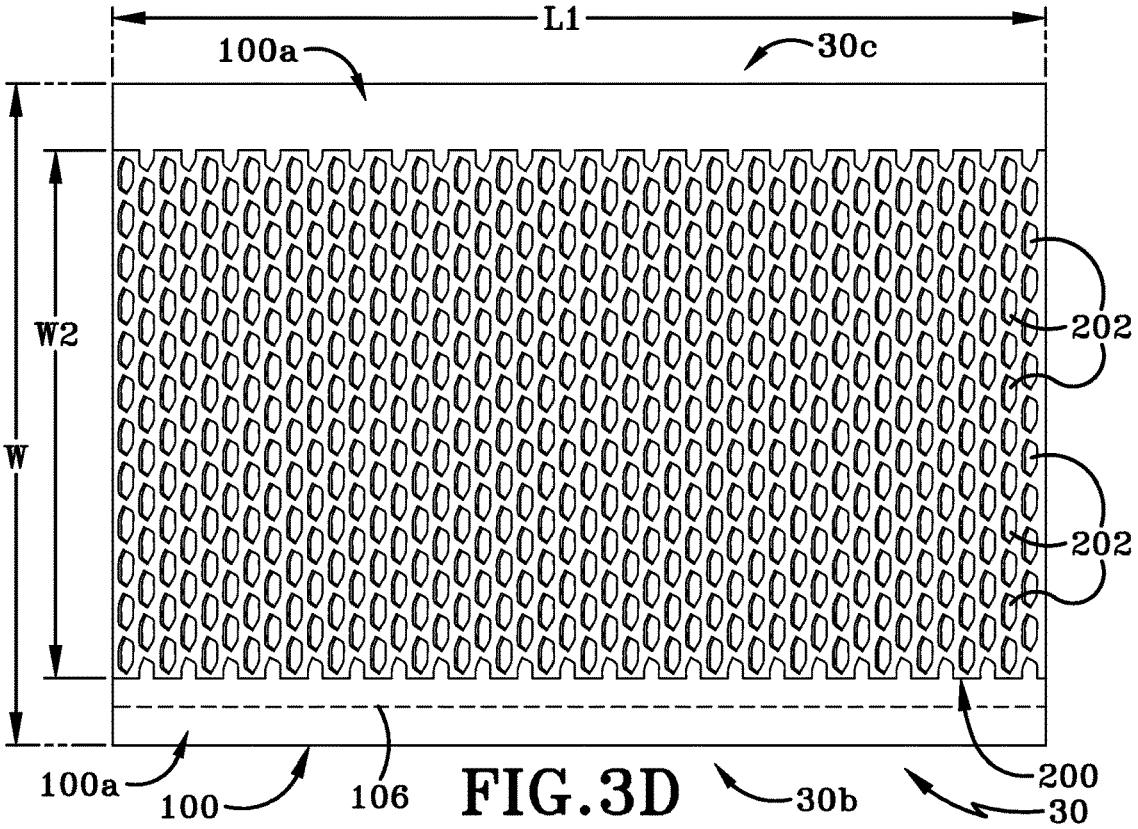
FIG. 3D is a top plan view of the length of packaging material of FIG. 3C shown in an expanded condition, and illustrating that the expanded second layer shrinks slightly in width.

FIGS. 3A and 3B show a portion of an exemplary first layer, or substrate layer 100 utilized in packaging material 30. First layer 100 is comprised of paper that may be reduced in length by a process of creping or folding the paper to form multiple wrinkles or multiple folds, e.g. Z-shaped wrinkles or folds 102, 104, which extend substantially normal to side edges of the first layer 100. Creping or folding first layer 100 will initially reduce the overall length of the first layer 100 from a length "L1" (FIG. 3D) to a length "L" (FIG. 3C). As will be described later herein, during use of packaging material 30, first layer 100 will be selectively expanded to its original, unwrinkled or unfolded length "L1" (FIG. 3D). First layer 100 is capable of expanding longitudinally when one end of the first layer 100 is pulled in a first direction "B" (FIG. 3A) that is normal to the wrinkles or folds 102, 104. When first layer 100 is pulled in the direction "B", the multiple wrinkles or folds 102, 104 unfold, thereby lengthening the first layer 100 from its wrinkled or folded length "L1" and returning first layer 100 to a generally unwrinkled or unfolded condition and generally to its original length "L". First layer 100 once expanded will form an outside surface of a final package that will ultimately be produced using packaging material 30.

Figure 3E:
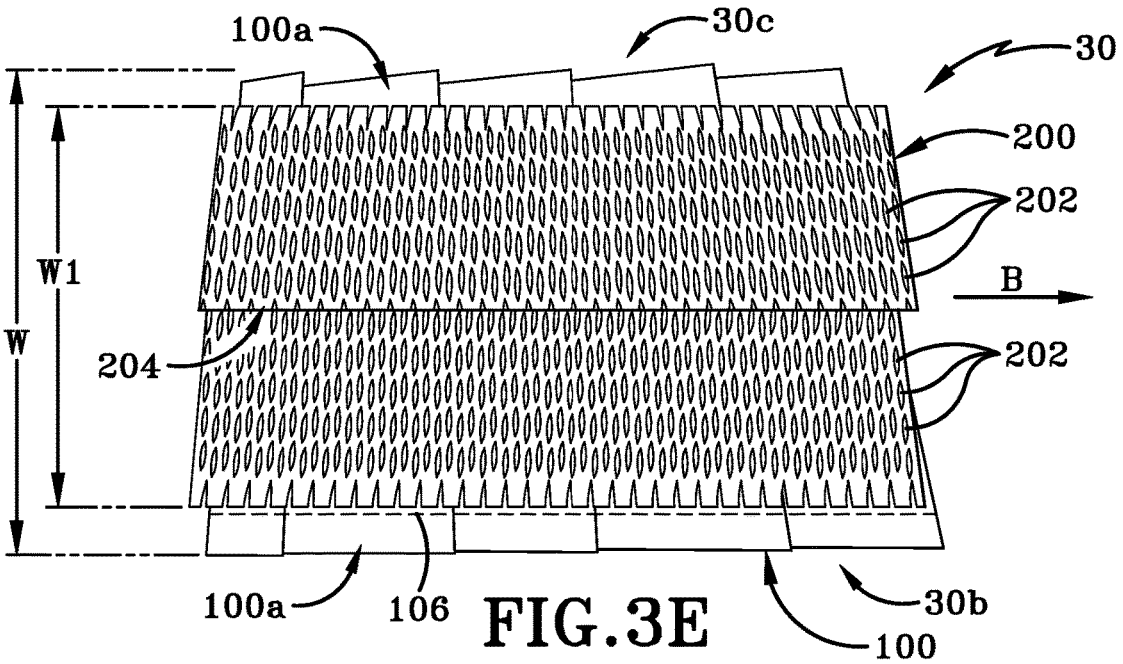
FIG. 3E is a top plan view of the length of packaging material similar to FIG. 3C, wherein both the expandable first layer and the expandable second layer are illustrated in an unexpanded condition.
Figure 3F:
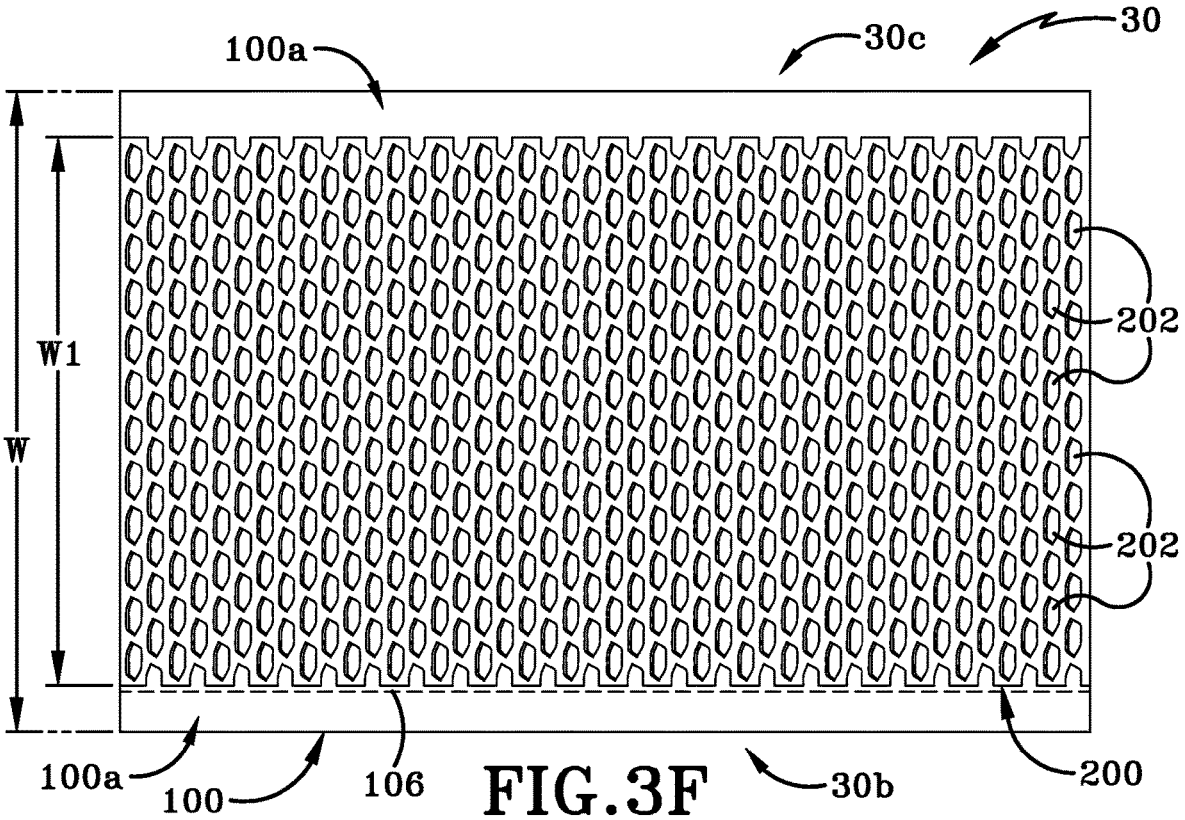
FIG. 3F is a top plan view of the length of packaging material of FIG. 3E shown in the expanded condition, and illustrating that the width of the expanded second layer is substantially unchanged.

In one embodiment, the first layer 100 may be formed of paper so that the packaging material formed therewith is paper-recyclable but in other embodiments the first layer may not be recyclable or may only be partially recyclable. The width of first layer 100 is indicated as "W" in FIGS. 3C and 3D and this width "W" remains unchanged whether packaging material 30 is in a folded condition or an expanded condition. FIGS. 3A and 3B show that a row of perforations 106, i.e., lines of weakness, may be formed a short distance inwardly from a first side edge of first layer 100. Alternatively, or additionally, another line of weakness may be formed a short distance inwardly from a second side edge of first layer 100. As can be seen in FIG. 3F, the first end of first layer 100 aligns with a first end 30*a* of a desired length of packaging material 30. The first side edge of first layer 100 aligns with a first side edge 30*b* of packaging material 30. The second side edge of first layer 100 aligns with a second side edge 30*c* of packaging material 30.

The packaging material 30 further includes a second layer 200 in the form of a cut-patterned layer (FIGS. 3C and 3D). Second layer 200 preferably is formed of paper so that it too is fully recyclable but in other embodiments second layer may not be recyclable or may only be partially recyclable. Second layer 200 includes a plurality of cuts 202 arranged in any suitable pattern. A lower surface of second layer 200 is adhered to first layer 100. In particular, the lower surface of second layer 200 may be spot-adhered to an upper surface of first layer 100. For example, adhesive may secure first and second layers 100, 200 to one another along regions proximate one or more wrinkles or folds 102, 104 in first layer 100. Second layer 200 is generally of the same length "L" as the first layer 100 when first layer is in the creped or folded condition (FIG. 3C), i.e., wrinkled or folded condition. The width of second layer 200 is indicated by the reference character "W1" when in an unexpanded condition as illustrated in FIG. 3C. As is evident from FIGS. 3C and 3D, the width "W1" of second layer 200 is smaller than the width "W" of first layer 100. As a result, a region 100*a* of first layer 100 is left on either side of second layer 200. The region 100*a* proximate first side edge 30*b* of first layer 100 includes the row of perforations 106.

Figure 3G:
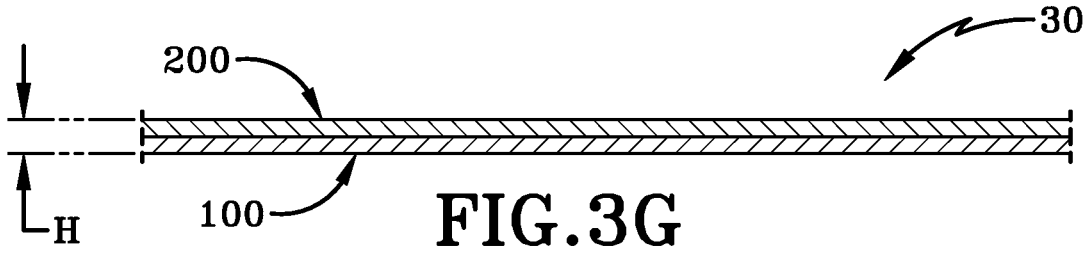
FIG. 3G is a diagrammatic side elevation view of the length of packaging material of FIG. 3C shown in the unexpanded condition.
Figure 3H:
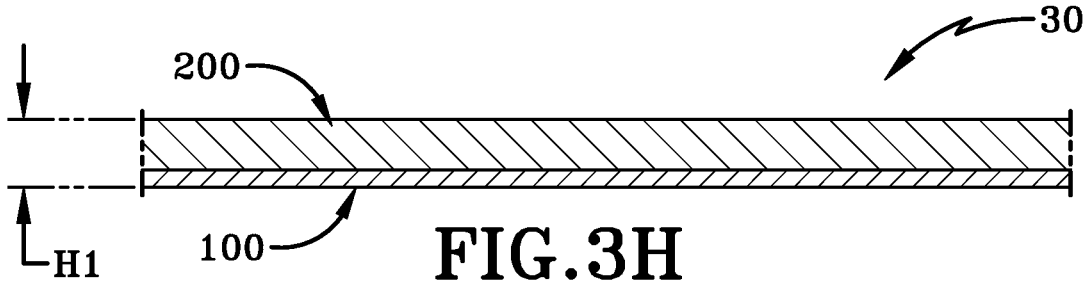
FIG. 3H is a diagrammatic side elevation view of the length of packaging material of FIG. 3D shown in the expanded condition and showing how the second layer has expanded in the Z-direction.

Second layer 200 is capable of being pulled or expanded in at least a first direction (e.g., two planes such as X, Y, or X and Y) that is effective to cause the second layer 200 to expand into at least one plane as shown in FIG. 3D and FIG. 3H. The expansion of first layer 100 causes the expansion in the second layer 200. Stated differently, first layer 100 is expandable in a horizontal plane (X or Y) and second layer 200 is expandable in the horizontal plane (X or Y), and also in a vertical plane (Z-direction) that is oriented substantially at right angles to the horizontal plane. When first layer 100 expands, second layer 200 tends to contract in a second direction (X or Y), which may include the direction normal to the direction in which the first layer 100 is pulled or extended. For example, when the first layer 100 expands and causes an expansion in second layer 200, the width of second layer 200 may decrease to a width "W2" (FIG. 3D).

In order to compensate for the contraction in a particular direction discussed above, the second layer 200 may initially be made longer and/or wider based on the direction in which the first layer 100 is expandable and therefore the direction in which second layer 200 will tend to contract. For example, second width 200 is indicated in FIG. 3E as being of a width "W1" but second layer 200 is actually wider than the width "W1". The extra width is accommodated in one or more wrinkles or folds 204. Wrinkles or folds 204 are aligned with the direction of unroll of packaging material 30 and will unfold as second layer 200 expands, thereby compensating for a reduction in the width thereof. During unfolding of the wrinkles or folds 204 the second layer 200 maintains the attached to first layer 100. FIG. 3F shows that when first layer 100 and the second layer 200 are fully expanded, first layer 100 is of a width "W" and the unfolded and expanded second layer 200 remains of the width "W1".

Preferably in such instances where second layer 100 is selected in a wider width than "W1", when second layer 200 is expanded, the reduced width of the expanded second layer 200 will tend to leave regions 100*a* on either side of the second layer 100 uncovered, and the row of perforations 106 will also not be covered by second layer 200.

Referring now to FIGS. 3G and 3H, when first layer 100 and second layer 200 are in a non-expanded condition (as in FIG. 3G), the overall thickness of the packaging material 30 is a height "H". When the packaging material 30 is expanded in the direction indicated by arrow "B" (FIG. 3C), the length of first layer 100 increases to length "L1". Similarly, the length of second layer 200 increases to the length "L1". The expansion of second layer 200 in an X or Y direction with first layer 100 will simultaneously cause expansion of the second layer 200 in the Z-direction. Expansion in the Z-direction will result in the overall height or thickness of the second layer 200 increasing, and therefore packaging material 30 increases to a height "H1" (FIG. 3H).

As second layer 200 expands in the Z-direction, the cuts 202 in second layer 200 will tend to open up and fill with air, and the expanded cut-patterned layer 200 thereby creates structural strength in the packaging material 30.

The difference between packaging material source 31 and packaging material source 30 is that the roll stock 31 illustrated in FIG. 1A is pre-fabricated to include the first layer 100 and second layer which are adhered to one another as shown in FIGS. 3C through 3H. The packaging material source 131 illustrated in FIG. 1B includes roll stock 131*a* that is comprised entirely of first layer 100 and roll stock 131*b* that is comprised entirely of second layer 200. The roll stock 131*a*, 131*b* are arranged so that first layer 100 is fed from roll stock 131*a* into assembly and laminating mechanism 131*c* and second layer 200 is fed from roll stock 131*b* and into assembly and laminating mechanism 131*c*. In the assembly and laminating mechanism 131*c*, the first and second layers 100, 200 are engaged with one another to form packaging material 30 which exits mechanism 131*c* and is put into use in system 10.

Referring to FIGS. 1A and 4 through 11, a method of using system 10 to custom package an article 16 will be discussed in greater detail. It will be understood that the method applies equally to the system illustrated in FIG. 1B.

FIG. 1A shows article 16 being moved in direction "A" by first conveyor 12 towards packaging station 24 of system 10 and towards a field of view of detecting device 26. As article 16 moves with first conveyor 12 into the field of view of detecting device 26 (FIGS. 1A and 4), the detecting device 26 scans article 16 to gather data about the external appearance of article 16. For example, detecting device 26 may measure the length, width, and height of article 16. Detecting device 26 will communicate the detected measurement data to PLC 27. Programming provided in PLC 27 will calculate the required length of packaging material 30 to form customized packaging for article 16. In other words, if article 16 is detected to be relatively small then a relatively small length of packaging material 30 will be required to form customized packaging for the article. If the article 16 is detected to be relatively large, then a relatively long length of packaging material 30 will be required to form customized packaging for the article.

Figure 4:
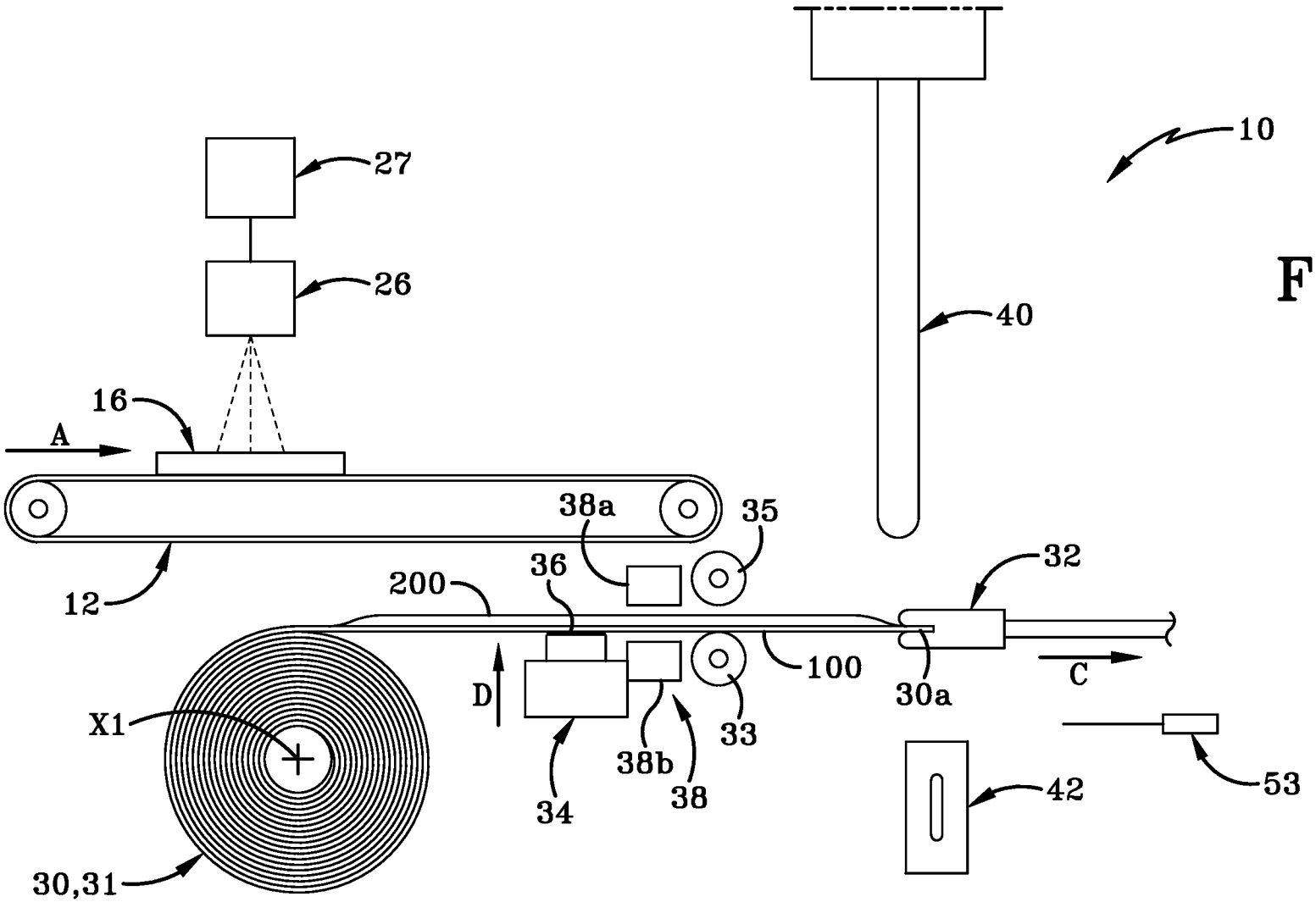
FIG. 4 is a diagrammatic side elevation view of the system of FIG. 1A showing a scanner detecting data relating to individual articles as the articles are moved by a conveyor through a field of view of the scanner, and further showing a label applicator applying a shipping label to a length of packaging material selected for packaging a specific article on the conveyor.

System 10 includes a tensioning mechanism which is operatively engaged with the packaging material 30 and is actuated to apply tension to a length of the packaging material 30 proximate the packaging station 24 and move the packaging material 30 from an unexpanded condition (such as is shown in FIG. 3G) to an expended condition (such as is shown in FIG. 3H). The tensioning mechanism illustrated as being used in system 10 is gripper mechanism 32 which is operatively engaged with PLC 27 and is controlled thereby. PLC 27 signals gripper mechanism 32 to extend and grasp a first end 30*a* of the packaging material 30 (as shown in FIGS. 1A and 4) and then move in the direction indicated by arrow "C" (FIG. 4) to unwind a required length of the packaging material from the packaging material source 31. The length of packaging material 30 unwound from packaging material source 31 is the required length for the particularly shaped and sized article 16 as calculated by the programming of the PLC 27.

It should be noted that the packaging material 30 of roll stock 31 is in a flat and unexpanded condition (such as is illustrated in FIGS. 3C and 3G). In other words, the first layer 100 is in a folded condition and the second layer 200 is flat and not expanded in the Z-direction. Additionally, the overall height (i.e., thickness) of the packaging material 30 is of the height "H" shown in FIG. 3G. As gripper mechanism 32 begins to move in the direction "C", as illustrated in in FIG. 4, roll stock 31 will rotate about the axis "X1" and will begin to unroll the specific required length of packaging material 30 therefrom as determined by PLC 27 from the measurement data received from detecting device 26.

As mentioned above, the packaging material 30 is initially in a flat, unexpanded condition as it is unrolled from roll stock 31 and tension (i.e., pulling force) is applied to the packaging material 30 by gripper mechanism 32. The application of tension causes first layer 100 of packaging material 30 to expand in a horizontal plane and in a longitudinal direction as gripper mechanism 32 moves in the direction "C". The expansion of first layer 100 in the horizontal plane causes second layer 200 to expand in the same horizontal plane and to simultaneously expand in the Z-direction. The increase in thickness of the packaging material 30 from height "H" (FIG. 3G) to height "H1" (FIG. 3H) is also shown in FIG. 4.

Figure 4A:
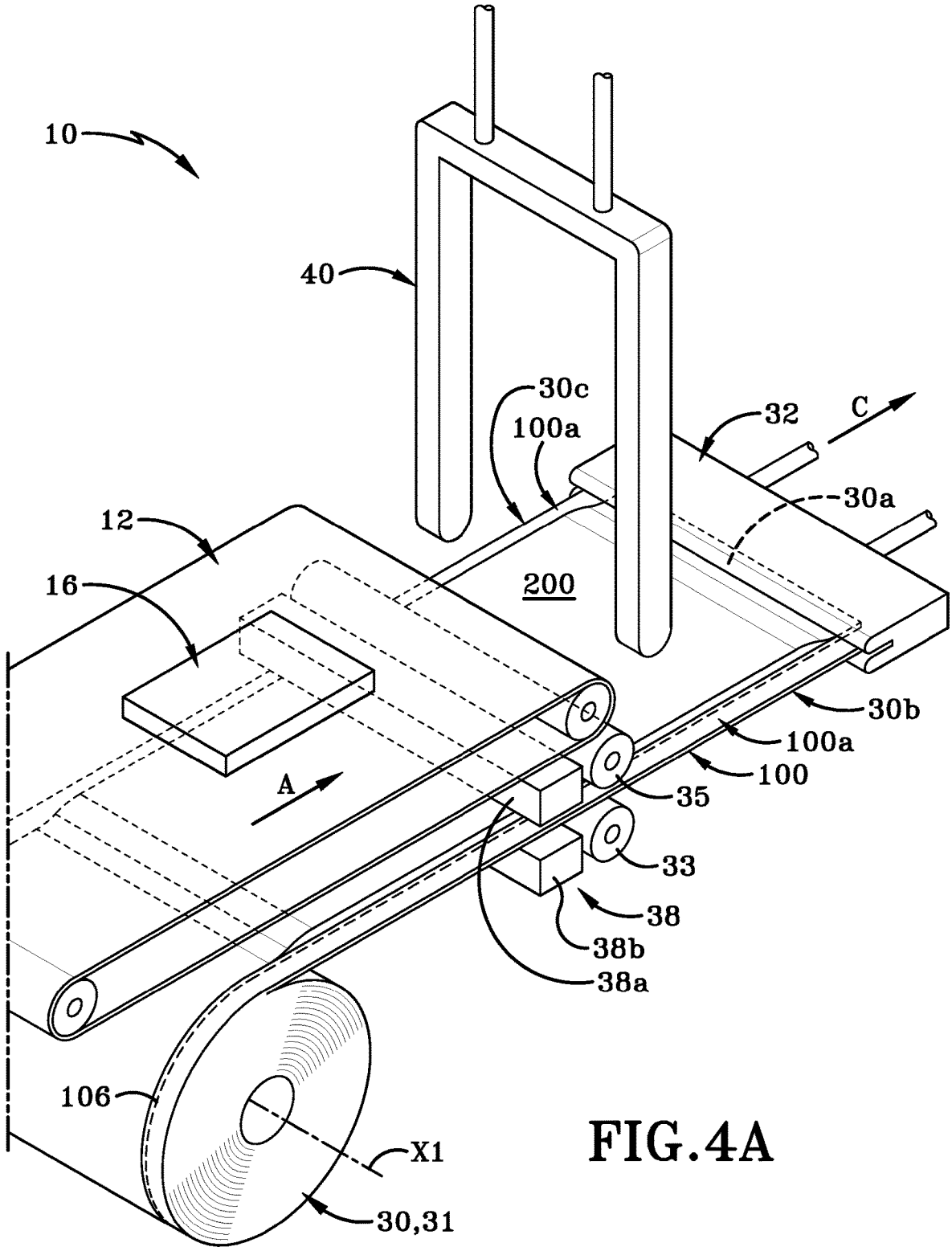
FIG. 4A is a diagrammatic, rear, right side, isometric perspective view of the system of FIG. 4 showing the specific article for packaging moving towards an end of the conveyor, and further showing a former beginning to move downwardly towards the expanding selected length of packaging material for packaging the specific article, and further showing opposing jaws of a sealing mechanism beginning to make contact with the upper and lower surfaces of the expanded packaging material.

It should be noted that the gripper mechanism 32 grasps the first end 30*a* of packaging material 30 across substantially the entire width (from side edge 30*b* to side edge 30*c*) as is illustrated in FIG. 4A. This manner of gripping first end 30*a* of packaging material 30 ensures that the cut-pattern of second layer 200 is maintained in a flat condition in the gripped first end 30*a* and is not able to be actuated to expand in the Z-direction when tension is applied to packaging material 30. Tension is controlled and maintained on the length of packaging material 30 by gripper mechanism 32 during unwinding from packaging material source 31. It should be further noted that the expanded first layer 100 is relatively free of wrinkles or fold lines after the expansion of first layer 100. First layer 100 will ultimately form the outermost layer of a final package that is produced by system 10.

It will be understood that any mechanism other than gripping mechanism 32 may be utilized to apply tension to packaging material 30 to cause the same to move from the unexpanded condition to the expanded condition.

A labeling mechanism 34 (FIGS. 1A and 4) also forms part of system 10. Labeling mechanism 34 is operatively engaged with PLC 27 and is controlled thereby. FIG. 4 shows labeling mechanism 34 being actuated by PLC 27 and moving in the direction indicated by arrow "D" to apply a shipping label 36 to a region of the lower surface of the length of expanded packaging material 30. In particular, shipping label is applied to the lower surface of expanded first layer 100. This lower surface will ultimately form the exterior surface of the final package produced by system 10. The shipping label 36 includes the address of the party to whom article 16 is to be shipped. It should be understood that labeling mechanism 34 may print the shipping information directly onto the lower surface of the packaging material 30 to form the shipping label 36 or a separate label that includes the shipping information or is previously or subsequently printed with the shipping information may be physically adhered to the lower surface of the packaging material 30 by labeling mechanism 34.

After application of shipping label 36, labeling mechanism 34 breaks contact with packaging material 30 and gripper mechanism 32 continues to move in the direction of arrow "C", drawing the required length of packaging material 30 towards the packaging station 24 (FIG. 1A through 1C).

System 10 further includes at least one pair of rollers 33, 35 and a sealing mechanism 38. Rollers 33, 35 and sealing mechanism 38 are operatively engaged with PLC 27 and are controlled thereby. FIG. 4A shows a rear perspective view of the gripper mechanism 32 grasping the full width of the packaging material 30 and pulling the length of packaging material 30 in the direction of arrow "C". The figure illustrates the article 16 continuing to be moved by first conveyor 12 in the direction of arrow "A". The expanded packaging material 30 passes between two jaws 38*a*, 38*b* of sealing mechanism 38 and subsequently between rollers 33, 35. (The purpose of sealing mechanism 38 and rollers 33, 35 will be described later herein.) It will be understood that in other embodiments, grippers may additionally or alternatively be moved into engagement with first and second sides 30*b*, 30*c* of packaging material 30 and then advancing the roll stock 31 without expanding the first layer 100 and/or second layer 200. The packaging material 30 may then be expanded later in the process.

FIG. 5 shows repositioning or reorienting device 13 discussed earlier herein contacting article 16 as the article approaches the end of first conveyor 12. The repositioning or reorienting device 13 may be utilized to cause the article 16 to be arranged in a particular orientation on first conveyor 12 if needed or desired. (In other embodiments the repositioning or reorienting device 13 may not be utilized at all or may be completely omitted from system 10.) FIG. 5 also shows the two jaws 38*a*, 38*b* of sealing mechanism 38 being moved in directions indicated by arrows "E" and "F", respectively, and into contact with opposing surfaces of the unwound and expanded packaging material 30. The pressure applied to packaging material 30 by jaws 38*a*, 38*b* causes packaging material 30 in the contacted region to return to its unexpanded height "H". Heat may also be applied by sealing mechanism 38 which activates adhesive in packaging material 30 and causes that adhesive to bond first layer 100 and second layer 200 to one another in the region contacted by sealing mechanism 38. Sealing mechanism 38 seals across the width of the packaging material 30 from first side 30*b* to second side 30*c* and this enables packaging material to be cut easily and cleanly in a subsequent step.

It will be understood that in other embodiments, jaws 38*a*, 38*b* of sealing mechanism 38 may not seal the packaging material 30 at this point in the process but may, instead, simply be used as a gripping mechanism for gripping and maintaining the condition of the roll stock 31 while the required length of packaging material 30 is being cut free from roll stock 31. Sealing may occur before or after this point in the process and any time before or after cutting of the packaging material 30.

Figure 6:
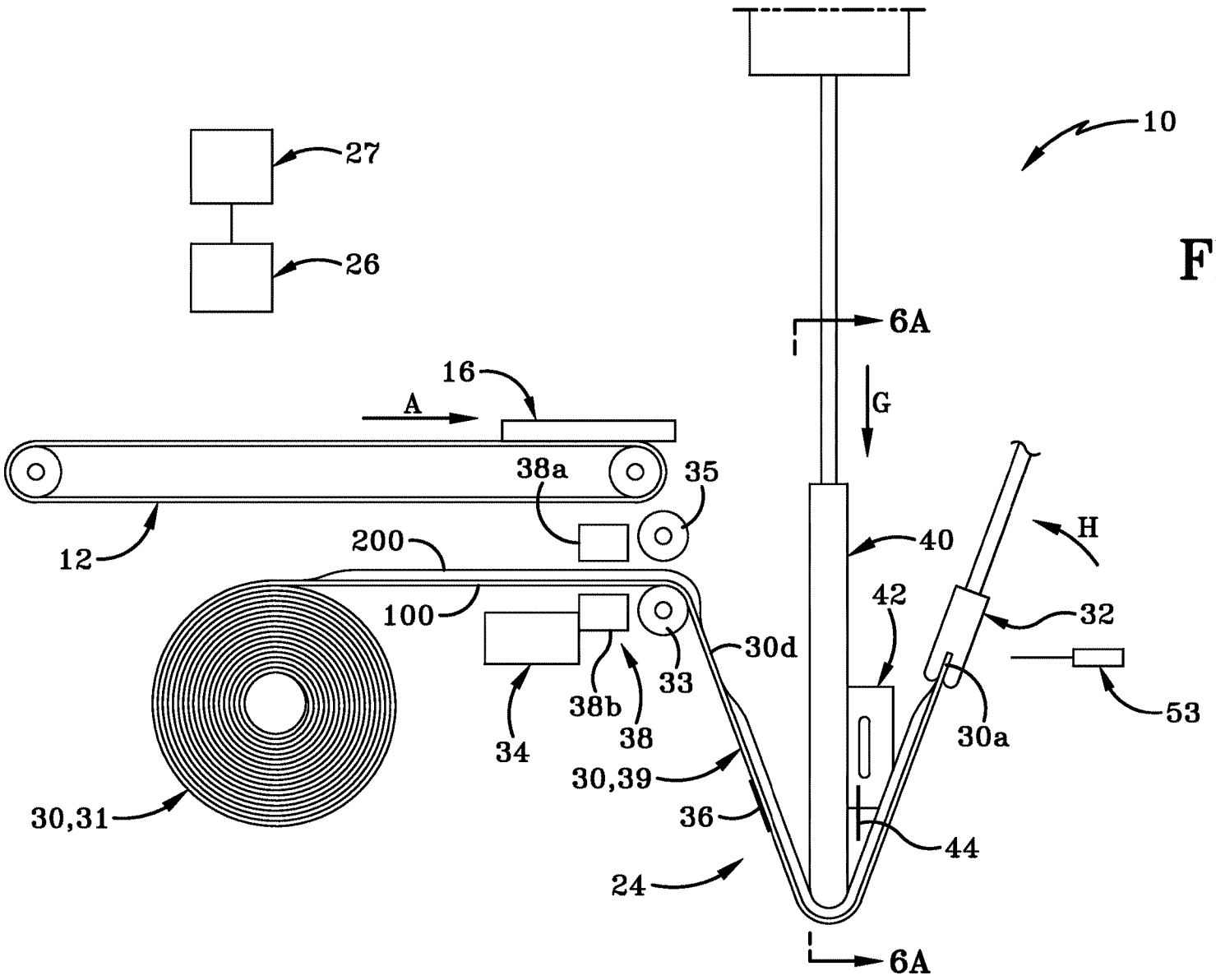
FIG. 6 is a diagrammatic side elevation view of the system of the present disclosure showing the former forming a package section in the expanded length of packaging material.
Figure 7A:
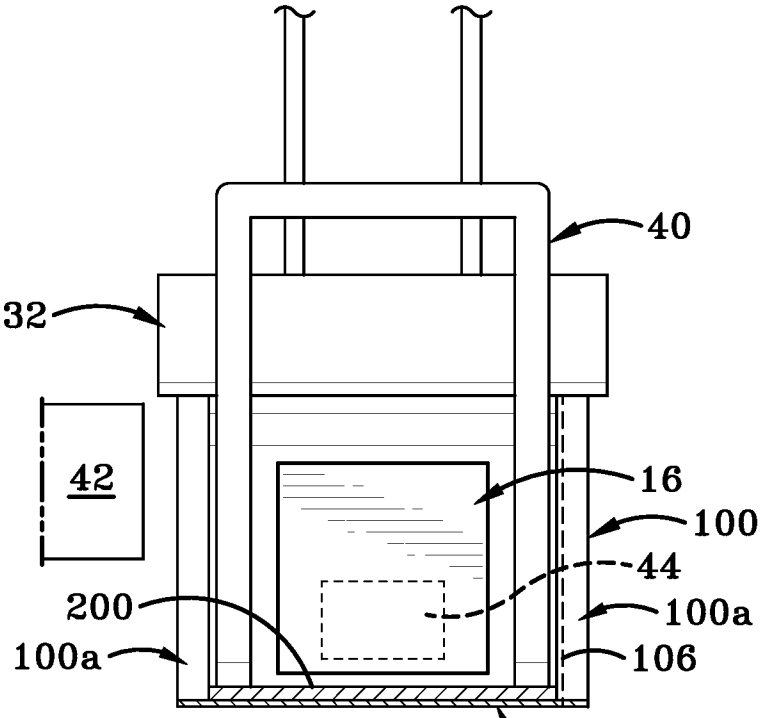
FIG. 7A is a rear elevation view of the package section taken along line 7A-7A of FIG. 7 and showing the article received therein.

System 10 further comprises a former 40 which is operatively engaged with PLC 27 and is controlled thereby. Former 40 is located at packaging station 24 of system 10. Former 40 is operable to contact the packaging material 30 and to form a generally V-shaped depression in the packaging material 30 and thereby form what will be called hereafter a "package section" 39. FIG. 6 shows former 40, actuated by PLC 27, moving downwardly in the direction of arrow "G", to contact a region of the upper surface of the length of packaging material 30 located in packaging station 24. Gripper mechanism 32 may be provided with a gripper motor which rotates gripper mechanism 32 upwardly in a direction indicated by arrow "H" while gripper mechanism 32 continues to grip first end 30*a* of packaging material 30. As former 40 moves in the direction "G", former 40 pushes part of the total required length of packaging material 30 downwardly in the direction "G" to a predetermined depth. The particular predetermined depth of the down-stroke of former 40 is calculated by the programming of PLC 27 based on the dimensions measured by detecting device 26. The pressure applied to packaging material 30 by former 40 causes packaging material 30 to form a generally V-shaped package section 39 as can be seen in FIG. 6. The movement of former 40 in the direction "G" is sufficient to cause the V-shaped depression of package section 39 to have dimensions sufficient to receive the individual article 16 therein. The action of former 40 is described in detail in U.S. Provisional Application Ser. No. 63/141,297 and U.S. patent application Ser. No. 17/514,005 referred to earlier herein.

It should be noted that as the former 40 moves downwardly in the direction of arrow "G", the jaws 38*a*, 38*b* of sealing mechanism 38 release the packaging material 30. A compressed section 30*d* of packaging material 30 compressed by sealing mechanism 38 enters the packaging station 24 and forms part of package section 39. It will be understood that the direction of movement of the former 40 illustrated and described herein is exemplary only and the former 40 may be configured to move in a different direction.

Figure 6A:
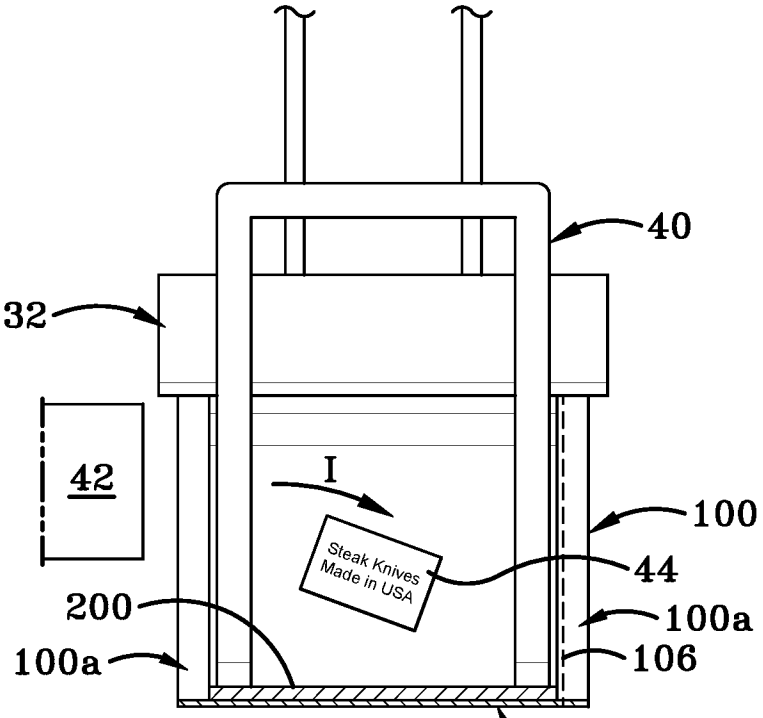
FIG. 6A is a rear elevation view of the package section taken along line 6A-6A of FIG. 6 and showing the former in contact with the expanded length of packaging material and showing a packaging slip being introduced into the package section.

System 10 further includes a package slip applicator 42 (FIG. 6) which is operatively engaged with PLC 27 and is controlled thereby. Package slip applicator 40 may print a packaging slip 44 or may be fed a pre-printed packaging slip 44, and inserts the same into the generally V-shaped package section 39 formed by former 40 in the length of packaging material 30. FIG. 6A shows a rear end view of part of the package section 39 with the former 40 in contact with the upper surface of the packaging material 30, the gripper mechanism 32 rotated into a more vertical orientation (shown in FIG. 6), and the packing slip 44 inserted in the direction "I" into the package section 39 by the package slip applicator 42. The packing slip 44 may include information such as the customer's purchase details and how to return the article to the retailer if defective or no longer wanted.

Figure 7:
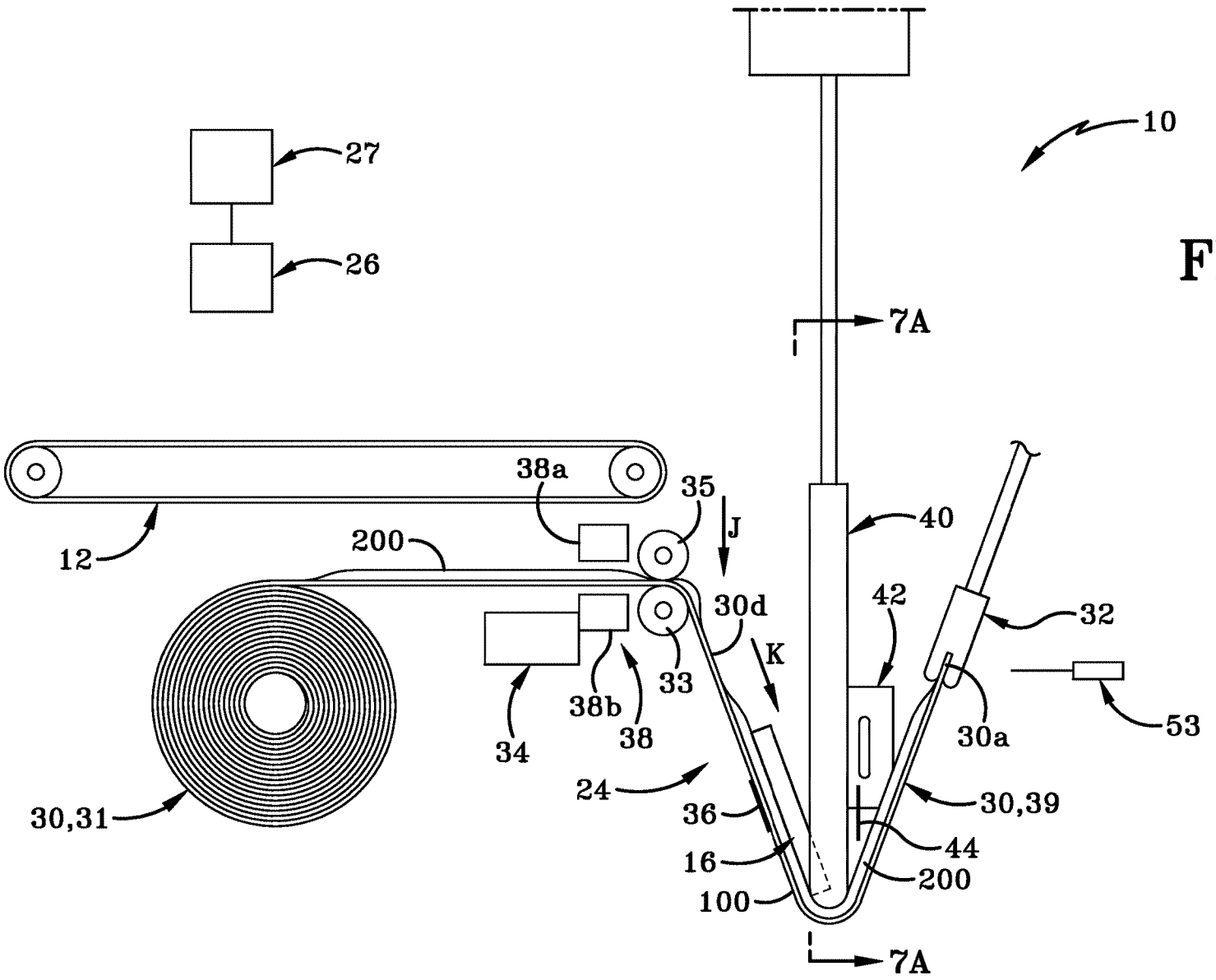
FIG. 7 is a diagrammatic side elevation view of the system of the present disclosure showing the article moved from the conveyor into the package section formed by the former.
Figure 8:
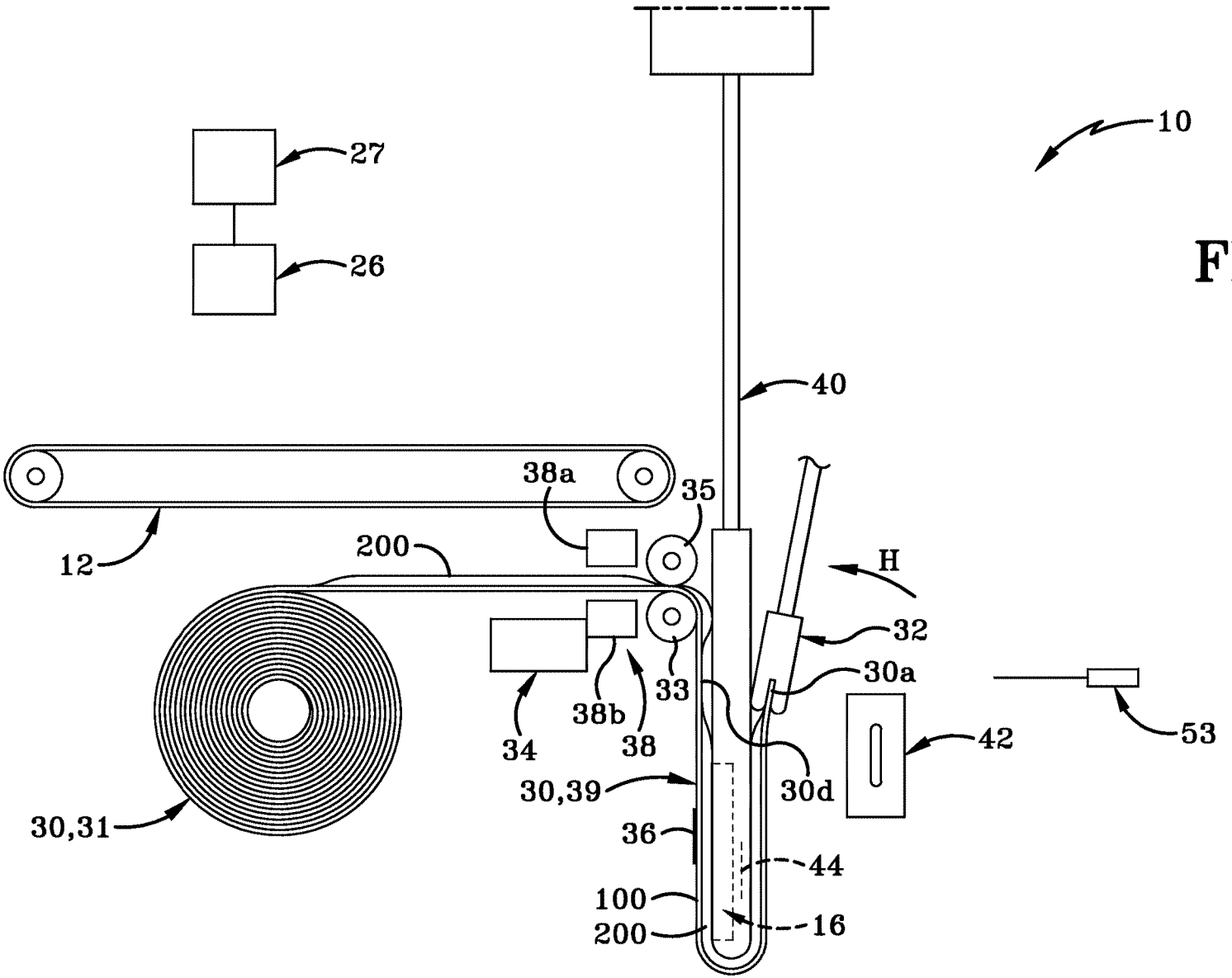
FIG. 8 is a side elevation view of the system of the present disclosure showing a gripper mechanism rotating the package section into a position ready for vertical edge sealing of the package section.

FIGS. 7 through 10 show how the V-shaped package section 39 is formed into a sealed final package by system 10. FIGS. 7 and 8 show rollers 33, 35 engaging packaging material 30 by roller 35 moving downwardly toward roller 33 in the direction indicated by arrow "J". Article 16 is moved from first conveyor 12, as indicated by arrow "K", into the generally V-shaped package section 39. This may be accomplished by providing a slide (not shown) as part of system 10 or by providing a grasping mechanism which grasps article 16 and places the same into the package section 39.

One or more scanners (not shown) may be provided as part of system 10 and may be utilized to check the sealing areas 100*a* (FIG. 3F) of the packaging material 30 in the package section 39 to ensure that the article 16 is not obstructing or otherwise interfering with the sealing areas 100*a*. If no such vertically-oriented obstructions are detected by the one or more scanners, then gripper mechanism 32 continues to rotate in the direction of arrow "H" bringing the sealing areas 100*a* of an interior first surface and an interior second surface of package section 39 closer to one another. When gripper mechanism 32 reaches the position shown in FIG. 8, former 40 is withdrawn from the interior of package section 39 in an opposite direction to arrow "G" (FIG. 6).

Figure 9:
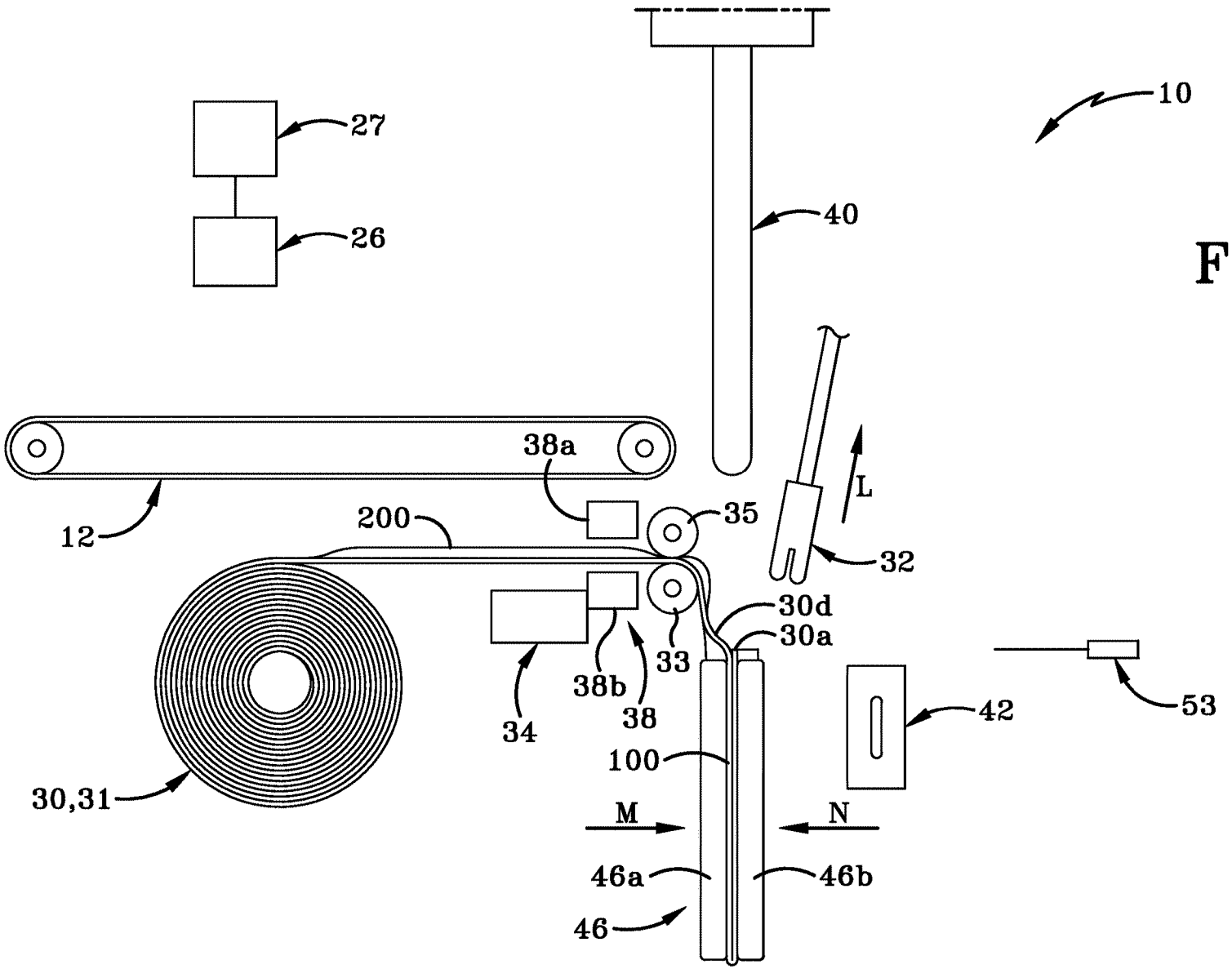
FIG. 9 is a side elevation view of the system of the present disclosure showing both the former and the gripper mechanism being retracted away from the package section and a vertical edge sealing mechanism moved to clampingly engage and seal the vertical side edges of the package section.

A vertical edge sealer 46 is also provided as part of system 10. FIG. 9 shows vertically-oriented sealing jaws 46*a*, 46*b* of edge sealer 46 being moved in the directions of arrows "M" and "N", respectively to contact package section 39. Jaws 46*a*, 46*b* compress and seal the sealing areas 100*a* of the two opposed interior first and second surfaces of package section 39 to one another. Prior to the compressing action of the jaws 46*a*, 46*b*, an adhesive may be applied to sealing areas 100*a* to enable bonding of the opposed first and second surfaces of package section 39 to one another.

Once the vertical side edges of package section 39 are sealed, PLC 27 signals gripper mechanism 32 to release the first end 30*a* of packaging material 30 and retract in the direction of arrow "L" (FIG. 9). Once edge sealer 46 seals the front and rear surfaces of the package section 39 to one another, a final package 50 is formed. The final package 50 retains article 16 within its interior cavity but the final package 50 is not yet sealed along its upper edge and remains attached to the packaging material 30 extending outwardly from roll stock 31. In particular, what will ultimately form a second end of the required length of packaging material required to package article 16 remains connected to the rest of the packaging material 30. This second end remains captured between rollers 33, 35.

Figure 10:
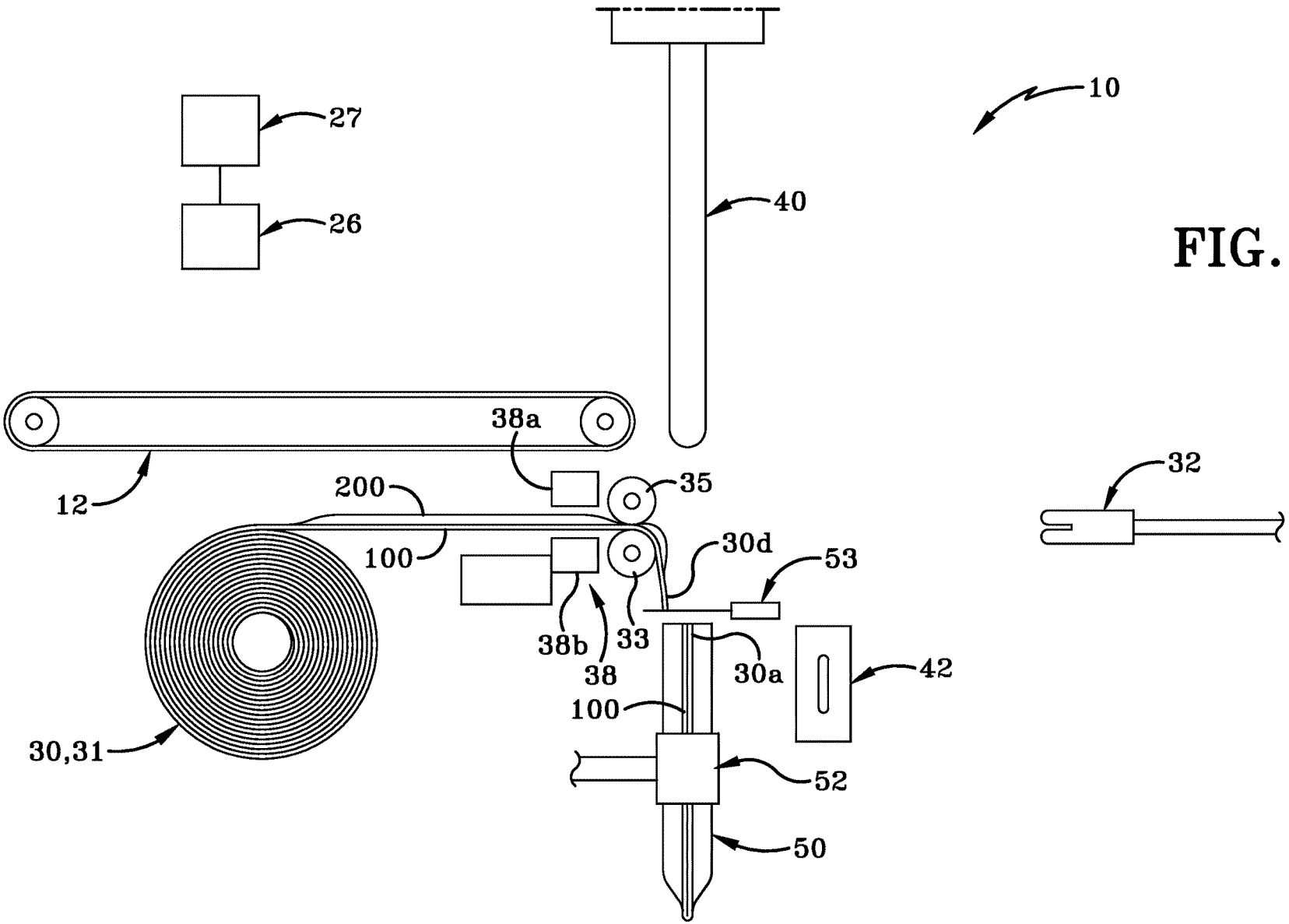
FIG. 10 is a side elevation view of the system of the present disclosure showing a region of the packaging material located rearwardly of the package section within which the article is retained, wherein the rearward region of the packaging material is being held in place and showing a cutter being utilized to sever the partially-sealed package section from the roll stock.

System 10 additionally includes a clamping mechanism 52, and a cutter 53 (FIG. 10) both of which are operatively engaged with PLC 27 and are controlled thereby. FIG. 10 shows clamping mechanism 52 gripping the unsealed final package 50 which is still connected to the rest of the packaging material 30. Once the unsealed final package 50 is gripped by clamping mechanism 52, edge sealers 46 release package 50. Cutter 53 is then actuated to cut the unsealed final package 50 from the rest of the packaging material 30. (It will be understood that the order of sealing and cutting packaging material 30 may be different from what is described above.) FIG. 10 also shows that gripper mechanism 32 has been rotated in the opposite direction to arrow "H" (FIG. 6) and has returned to its starting position (FIG. 1A).

Figure 11B:
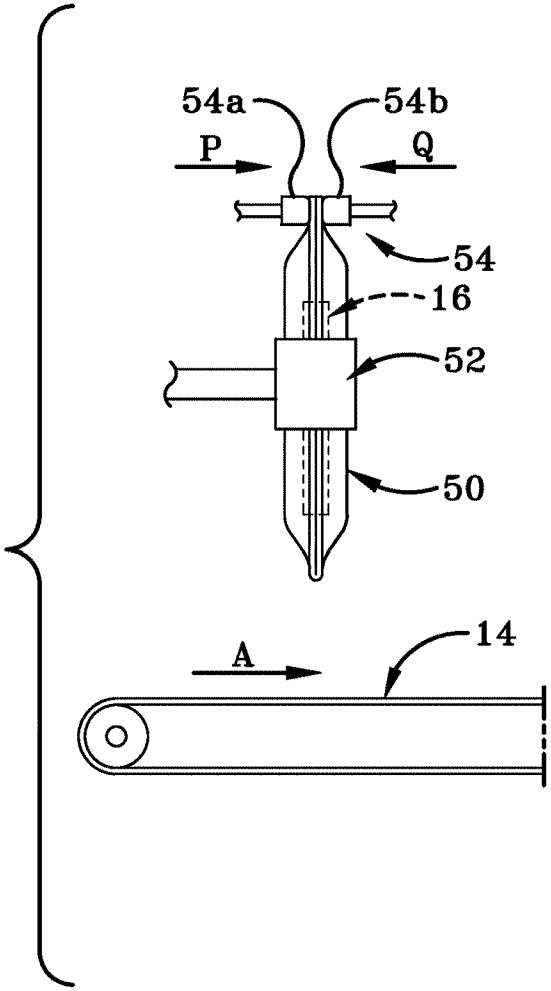
FIG. 11B is a partial side elevation view similar to FIG. 11*a* showing the jaws of the horizontal edge sealer sealing the horizontally-oriented upper edge of the package section, and further showing the package section being positioned vertically above a discharge conveyor.
Figure 11A:
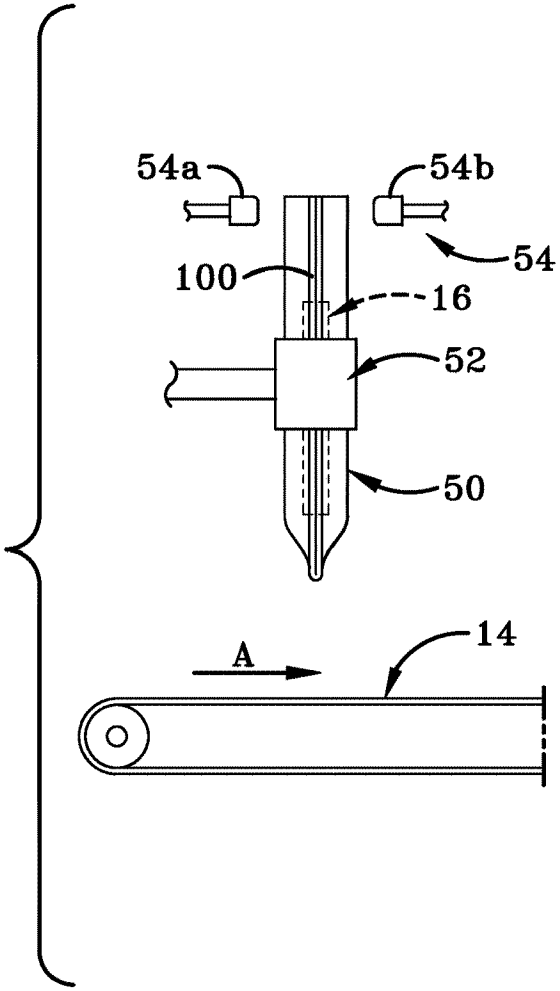
FIG. 11A is a partial side elevation view showing the package section, with vertical side edges sealed, being gripped by an auxiliary gripper mechanism, and further showing a horizontal edge sealer's jaws readied to seal the horizontally-oriented upper edge of the package section.

System 10 further includes horizontal sealing jaws 54*a*, 54*b*. FIGS. 11A and 11B show horizontal sealing jaws 54*a*, 54*b* moving inwardly in the directions "P" and "Q", respectively, to seal the upper edge of final package 50, i.e., the first end and the second end of the required length of packaging material are sealed to one another. In some instances, the compressed section 30*d* of the packaging material 30 may be gripped and folded over the first end 30*a* of the packaging material 30 and then the compressed section 30*d* will be sealed to the second surface of the final package 50 by the sealing jaws 54*a*, 54*b*. An adhesive may be applied to the surfaces of the unsealed final package 50 before the sealing jaws 54*a*, 54*b* are moved into engagement therewith to seal the same.

FIGS. 11A and 11B show that the final package 50 is positioned above discharge conveyor 14. Once the horizontal upper end of the final package 50 has been sealed as described above, the clamping mechanism 52 will release the final package 50 which will then drop onto the discharge conveyor 14.

Figure 12:
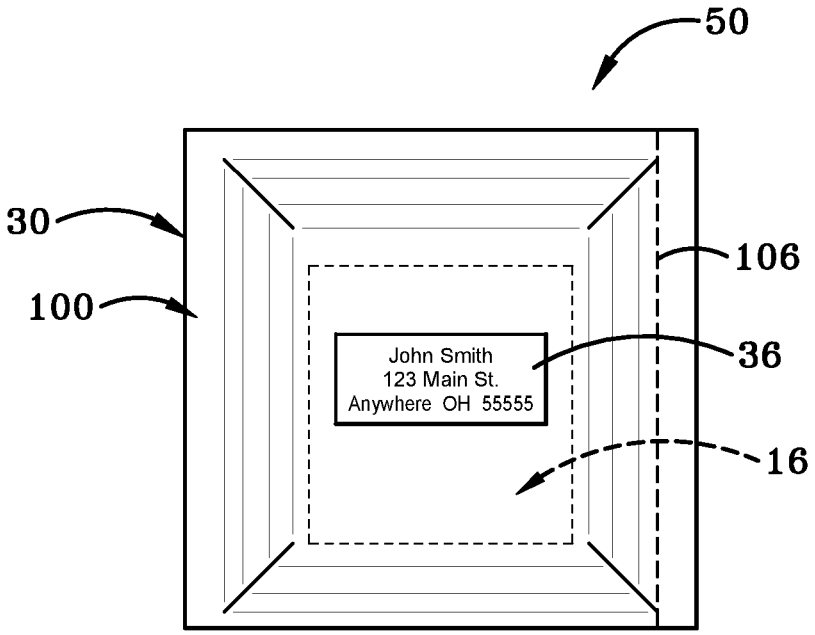
FIG. 12 is a diagrammatic front elevation view of a custom-fabricated envelope for the specific article shown in FIG. 6 showing the shipping label for mailing the article to a customer which was applied to the length of packaging material by the label applicator as illustrated in FIG. 4.

FIG. 12 shows the sealed final package 50 with the article 16 safely retained therein and surrounded by the expanded packaging material 30. As indicated earlier herein, the expanded second layer 200 of the expanded packaging material 30 gives structural strength to the final package 50 to protect the article 16 retained therein. The expanded second layer 200 acts like bubble wrap, generally absorbing impacts that are typically experienced by packages which are mailed or delivered by a courier service. The expanded second layer 200 of the package 50 therefore protects the enclosed article 16 from typically experienced impacts during delivery.

Once the customer has the sealed final package 50 delivered to them, they may utilize the line(s) of perforations 106 to tear a section of the package away from the rest of the package so that the interior of the final package 50 can be accessed and the article 16 be removed therefrom.

A method of custom packaging an article 16 in accordance with aspects of the present disclosure includes providing a system 10 or automatically custom packaging each individual article, e.g., article 16 of a plurality of articles 16, 18, 20, and 22; feeding packaging material 30 from a packaging material source 31 or 131 of the system 10 to a packaging station 24 of the system 10; moving the plurality of articles 16, 18, 20, 22 along a first conveyor 12 of the system 10 and towards the packaging station 24; scanning the individual article 16 of the plurality of articles 16, 18, 20, 22 with a detecting device 26 of the system 10 prior to the individual article 16 reaching the packaging station 24; sending scanned data with respect to the individual article 16 from the detecting device 26 to a processor 27 of the system 10; calculating, with programming provided to the processor 27, a length of the packaging material 30 required to package the individual article 16; moving the packaging material 30 from a unexpanded condition (FIG. 3G) to an expanded condition (FIG. 3H) to form expanded packaging material as shown in FIG. 3H; forming, with a former 40 of the system 10 in the packaging station 24, a package section 39 from the expanded packaging material 30, depositing the individual article 16 into the package section 39; and sealing, with a sealing mechanism 38 of the system 10, the package section 39 around the individual article 16 to form a final package 50.

Figure 13:
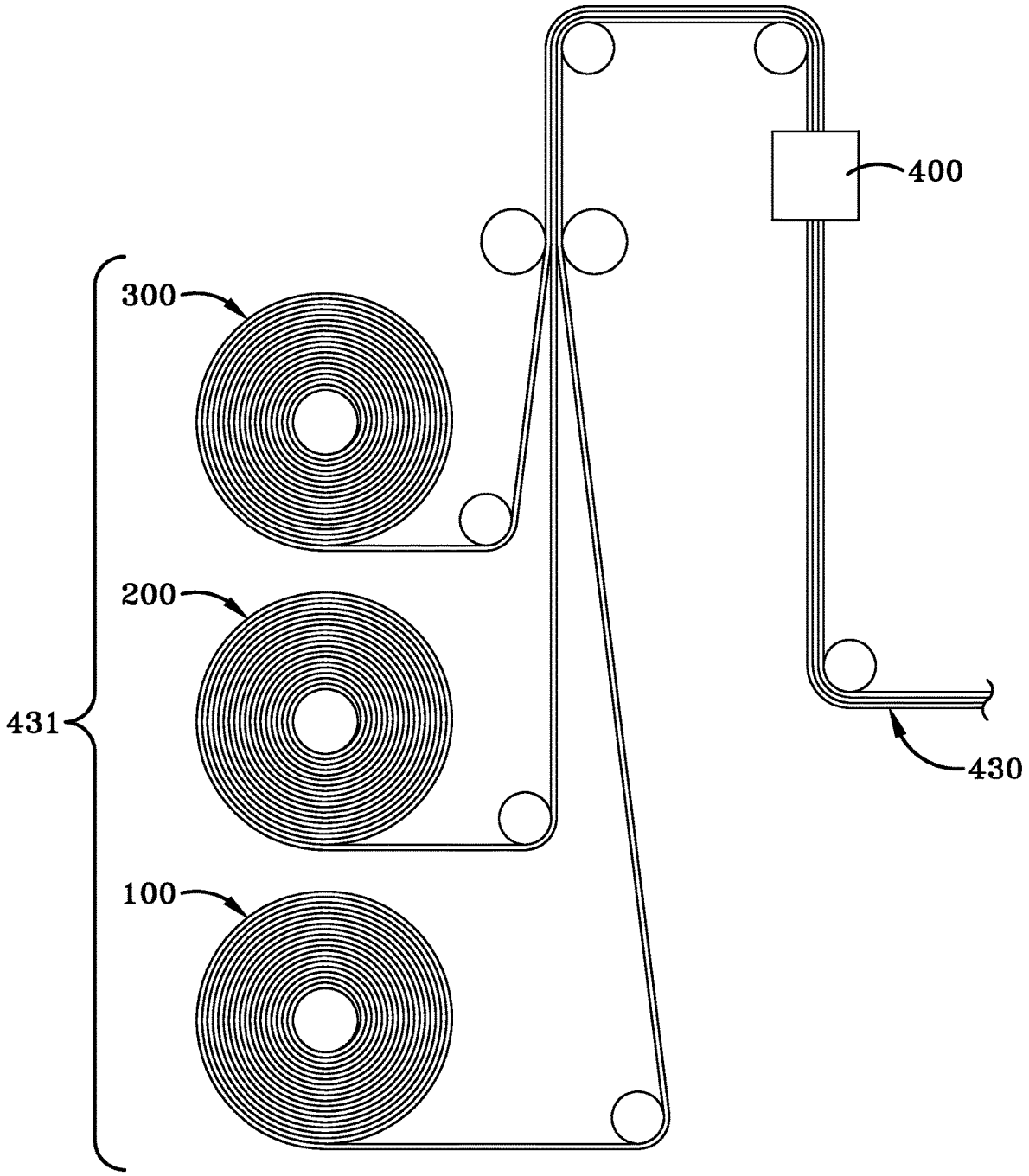
FIG. 13 is diagrammatic side elevation showing a further apparatus for producing packaging material in situ and in real time, wherein the apparatus could be positioned in the system in the place of the previously-manufactured roll stock of FIG. 1A or in place of the in-situ manufactured two-layer roll stock illustrated in FIG. 1B.

The method further comprises providing roll stock 31 of pre-fabricated packaging material 30 as the packaging material source 31 as shown in FIG. 1A. The method further comprises assembling packaging material 30 in situ as the packaging material source 131 as shown in FIG. 1B. In this latter method, the assembling of the packaging material 30 is accomplished using an assembly and laminating mechanism 131*c* as shown in FIG. 1B (or 400 as shown in FIG. 13) of the system 10 into which is fed roll stock of a first layer 100 and roll stock of a second layer 200 wherein the first layer 100 and the second layer 200 differ from one another in at least one characteristic. Preferably the first layer 100 and second layer 200 comprise recyclable materials but in other instances one or both of the layers 100, 200 may only be partially recyclable or non-recyclable. Moving of the length of the packaging material 30 to the expanded condition (FIG. 3H) includes applying tension to the packaging material 30 with a tensioning mechanism 32 of the system 10. The method includes expanding the first layer 100 of the packaging material 30 in a horizontal plane (as shown in FIGS. 3C and 3D), in response to applying tension to the packaging material. The method further includes expanding the second layer 200 of the packaging material 30 in a vertical plane (as shown in FIG. 3H) in response to expanding the first layer 100 in the horizontal plane.

The method further comprises cutting, with a cutter 53 of the system 10, the final package 50 from a remaining length of the packaging material 30 moving towards the packaging station from the packaging material source 31 or 131. The method further includes depositing the final package 50 on a discharge conveyor 14; and moving the final package 50 away from the packaging station 24 of the system 10 on the discharge conveyor 14. The method may further comprise repositioning or reorienting the individual article 16 on the first conveyor 12 with a repositioning or reorienting device 13 prior to the individual article 16 reaching the packaging station 24. The method further comprises automatically forming the final package 50 in real time, wherein the real time is a time taken for the individual article 16 to travel along the first conveyor 12, be scanned by the detecting device 26, forming the package section 39 in the packaging material 30 with the former 40, depositing the individual article 16 into the formed package section 39 and sealing the package section with a sealing mechanism 38.

It will further be understood that the sequence of operations performed in system 10 may be other than as described and illustrated herein.

FIG. 13 shows an alternative packaging material source that may be provided on system 10 in place of the packaging material source 31. The system 10 is not illustrated in this figure but should be understood to be identical in components, structure, and function to the system illustrated in FIGS. 1-12 and discussed above. In the embodiment shown in FIGS. 1A and 1B13 there is shown a two-layered pre-fabricated roll stock 31 or a two-layered roll stock 131 used to construct the packaging material in situ as part of the packaging process. FIG. 13, on the other hand, shows three-layered roll stock 430. FIG. 13 shows the same first layer 100 and second layer used om packaging material 30 but further includes a third layer 300 which is operatively engaged with the other two layers 100, 200 to form the packaging material 430. In this instance, whether being pre-fabricated or constructed in situ, sheet material is unwound from a roll of a first layer 100, a roll of a second layer 200, and a roll of a third layer 300 and passes through an assembly and laminating mechanism 400 to form a three-layered packaging material 430. Assembly and laminating mechanism 400 bonds the materials 100, 200, 300 from the respective roll stock into a single laminated sheet of three layers, thereby forming packaging material 430. Packaging material 430 is used in an identical manner to packaging material 30. Packaging material 430 will be fabricated in situ in a similar manner as illustrated in FIG. 1B instead of being produced elsewhere and shipped as a completed packaging material source to a facility where articles are to be packaged.

The three layered packaging material 430 may include a first layer 100 and third layer 300 that are substantially identical to one another. In this instance, first layer 100 is adhered to a lower surface of second layer 200 and third layer 300 is adhered to an upper surface of second layer 200. It should be noted that wrinkles or folds (not shown) in the third layer 300 may be oriented in a same direction as the wrinkles or folds 102, 104 in first layer 100. In this instance, the wrinkles or folds in third layer 300 will be expandable in a substantially identical manner to the wrinkles or folds in the first layer 100. In other embodiments, the wrinkles or folds in the third layer 300 may be arranged differently from the wrinkles or folds in the first layer 100.

Packaging material 430 is processed in system 10 in the same manner as is illustrated in FIGS. 1A through 12. When tension is applied to packaging material 430 by gripper mechanism 32 (as illustrated in FIG. 4), both first layer 100 and third layer 300 will expand in a first plane. The expansion of first layer 100 and third layer 300 in the first plane will cause expansion of second layer 200 in the first plane and in a second plane which is oriented at ninety degrees to the first plane. In other words, the second layer 200 will expand in the Z-direction. The expanded second layer 200 is sandwiched between the first layer 100 and third layer 300. One of the first layer 100 and third layer 300 may form the outside of the final package 50 and the other of the first layer 100 and third layer 300 will form the inside of the final package 50.

It will be understood that more than one additional layer having the structure of the first layer 100, second layer, and third layer 300 may be provided in the packaging material 430 in accordance with the present disclosure.

Various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

It will be understood, as described above that it is needful that the first layer 100 and second layer 200 (and third layer 300, if provided) of the packaging material be expanded by system 10. However, the manner of expansion of layers 100, 200 will be based on the arrangement of the wrinkles or folds 102, 104 in first layer 100 and therefore the direction in which expansion of first layer 100 is possible. FIGS. 3A through 3H shows wrinkles or folds 102, 104 in first layer 100 arranged to permit longitudinal expansion of first layer 100. The expansion of first layer 100 may simply occur through the application of tension to packaging material 30 based on the pulling motion applied to packaging material by gripping mechanism 32 in unwinding the length of the packaging material 30 from the packaging material source 31. The tension applied as gripping mechanism 32 unwinds the packaging material 30 will cause longitudinal expansion of first layer 100 in a manner similar to that illustrated in FIGS. 3B through 3D. Expansion of first layer 100 will, in turn, cause the second layer 200 to expand longitudinally and thereby second layer 200 will expand in the Z-direction as illustrated in FIGS. 3D and 3H.

In other embodiments (not illustrated herein) instead of tension applied by gripper mechanism 32 causing expansion of packaging material, the PLC may control a powered unwind of roll 31 and an air bladder in a core of the material roll 31 may power the unwind and may or may not be synched to the gripping mechanism 32 to work together to unwind the packaging material 30.

In other embodiments (not illustrated herein) instead of the tension applied by gripper mechanism 32 causing expansion through unwinding of the packaging material 30 from the packaging material source 31 being the force that expands first layer 100, PLC 27 may temporarily halt rotation of packaging material source 31 after the desired length of packaging material for article 16 has been unwound. PLC 27 may signal gripper mechanism 32 to continue to move in the direction "C" and this continued movement of gripper mechanism 32 away from the packaging material source 31 will cause first layer 100 to expand longitudinally. In other embodiments, the gripping mechanism 32 may be synched to travel slightly faster than the unwinding of the material roll 32 in order to cause the tension needed to expand the first layer. As first layer 100 expands longitudinally, second layer 200 will expand longitudinally and as it does so, second layer 200 will also expand in the Z-direction as shown in FIGS. 4 and 3H.

In yet other embodiments (not illustrated herein) when the desired length of packaging material 30 has been unwound from packaging material source 31, the jaws of an auxiliary gripper mechanism (not shown) may be brought into engagement with the upper and lower surfaces of the packaging material 30 a distance longitudinally away from gripper mechanism 32 and in a location between the packaging material source 31 and gripper mechanism 32. The jaws of the auxiliary gripper mechanism may clampingly engage the packaging material therebetween. One or both of the gripper mechanism 32 and the auxiliary gripper mechanism may then be moved away from the other, thereby increasing the longitudinal distance between the two gripper mechanisms. The tension applied by the two gripper mechanisms moving apart from one another will cause the first layer 100 of the packaging material 100 to expand longitudinally, thereby expanding the second layer longitudinally, and thereby causing the second layer 200 to expand in the Z-direction.

It will be understood that if the wrinkles or folds 102, 104 in first layer 100 are arranged parallel to the first side edge 30*b* and second side edge 30*c* of the packaging material 30 then expansion aligned with a transverse axis of the packaging material 30 is possible but expansion in a longitudinal direction will not be possible. The mechanisms for expanding the first layer as described above will not be able to cause lateral expansion of the first layer. Consequently, when the first layer is differently folded, different expansion mechanisms are required in the system 10. For example, a pair of auxiliary gripping mechanisms may be moved into engagement with the first side edge 30*b* and second side edge 30*c* of the packaging material 30. One or both of the pair of auxiliary gripping mechanisms may be moved away from the other of the pair, thereby causing the first layer 100 of the packaging material 30 to expand transversely. The transverse expansion of the first layer 100 will cause an expansion of the second layer 200 in the transverse direction, and subsequent expansion of the second layer 200 in the Z-direction.

It will further be understood that if there are more than just the first layer 100 and second layer 200 present in the packaging material 30, then appropriate tensioning, halting of rotation of the packaging material source 31 and continued movement of the gripper mechanism 32, and the use of one or more auxiliary gripping mechanisms (acting to cause longitudinal expansion and/or lateral expansion of packaging material) may be utilized to expand the multiple layers of the packaging material appropriately.

In one aspect, the packaging material 30 will include a third layer that is adhered to a surface of the second layer 200 opposite to the surface of the second layer 200 that is adhered to the first layer 100. The third layer will be substantially identically configured to the first layer 100 and will expand in a similar manner. The second layer 200 when expanded in the Z-direction will be sandwiched between the first layer 100 and the third layer.

It should be noted that when packaging material 30 is unrolled from the packaging material source 31, as shown in FIG. 2, the first layer 100 and second layer 200 (and third layer, if provided) is not in an expanded condition. As a consequence, the second layer 200 is flat, i.e., the cut-pattern of second layer 200 has not been expanded in the Z-direction. Stated another way, the packaging material 30 is 2-Dimensional having only a length and width but effectively is of a relatively small height (i.e., thickness) similar to what is shown in FIG. 3G. FIGS. 3H and 4 show that after the expansion of first layer 100 and the subsequent expansion of the second layer 200, the packaging material 30 is 3-Dimensional and the height or thickness of the packaging material has increased (see FIG. 3H). Sealing areas 100*a* are provided along the vertical side regions of the packaging material 30 as shown in FIG. 4. In these sealing areas 100*a* only the first layer 100 is present. The purpose of sealing areas 100*a* will be described later herein.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. Some exemplary modifications to the system 10 and method will be described herein. Instead of the packaging material 30 being cut to the cut length as described above, it is to be envisioned that the packaging material 30 may be cut to the desired length earlier in the process, and, in that case, one or more tensioning devices (i.e., gripper mechanisms) may be used to grip the first end 30*a* and the second end 30*d* of the packaging material 30 for further processing. Instead of sealing the vertical side seal areas 100*a* and then sealing the horizontally-oriented upper end of the final package, the order of sealing sections of the final package may be different from what is described herein. Instead of the shipping label 36 being applied as described above, the shipping label 36 may be applied to the packaging material 30, or to the final package 50, at any suitable time throughout the packaging process and may be placed at any suitable location on the packaging material 30 or the final package 50. Instead of the packaging slip 44 being inserted as described earlier herein, it is to be envisioned that the packaging slip 44 may be inserted within the final package 50 at any suitable time throughout the packaging process. Instead of utilizing one former 40, it is to be envisioned that the system 10 may utilize one or more formers 40 that may be differently arranged and may rotate to optimize the forming of the packages 50. The system 10 may be implemented as an inline machine (i.e., steps of the packaging process occur substantially along a line), and as a side transfer machine (i.e., the system 10 may transfer lengths of the packaging material at an angle for one or more steps of the packaging process). Instead of forming the U-shaped or V-shaped package section 39 of the packaging material 30 with the former 40, it is to be understood that the area for receiving article 16 may be formed in any suitable manner. Instead of the packaging material source 31 being positioned under the first conveyor 12, it is to be understood that the packaging material source 31 may be provided in any suitable location, such as, for example, a longitudinal distance away from the first conveyor 12. It is to be envisioned that once the final package 50 is formed, the system 10 may discharge the final package 50 in any suitable number of directions.

More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

The above-described embodiments can be implemented in any of numerous ways. For example, embodiments of technology disclosed herein may be implemented using hardware, software, or a combination thereof. When implemented in software, the software code or instructions can be executed on any suitable processor or collection of processors, whether provided in a single computer or distributed among multiple computers. Furthermore, the instructions or software code can be stored in at least one non-transitory computer readable storage medium.

Also, a computer or smartphone utilized to execute the software code or instructions via its processors may have one or more input and output devices. These devices can be used, among other things, to present a user interface. Examples of output devices that can be used to provide a user interface include label applicators or display screens for visual presentation of output and speakers or other sound generating devices for audible presentation of output. Examples of input devices that can be used for a user interface include keyboards, and pointing devices, such as mice, touch pads, and digitizing tablets. As another example, a computer may receive input information through speech recognition or in other audible format.

Such computers or smartphones may be interconnected by one or more networks in any suitable form, including a local area network or a wide area network, such as an enterprise network, and intelligent network (IN) or the Internet. Such networks may be based on any suitable technology and may operate according to any suitable protocol and may include wireless networks, wired networks or fiber optic networks.

The various methods or processes outlined herein may be coded as software/instructions that is executable on one or more processors that employ any one of a variety of operating systems or platforms. Additionally, such software may be written using any of a number of suitable programming languages and/or programming or scripting tools, and also may be compiled as executable machine language code or intermediate code that is executed on a framework or virtual machine.

In this respect, various inventive concepts may be embodied as a computer readable storage medium (or multiple computer readable storage media) (e.g., a computer memory, one or more floppy discs, compact discs, optical discs, magnetic tapes, flash memories, USB flash drives, SD cards, circuit configurations in Field Programmable Gate Arrays or other semiconductor devices, or other non-transitory medium or tangible computer storage medium) encoded with one or more programs that, when executed on one or more computers or other processors, perform methods that implement the various embodiments of the disclosure discussed above. The computer readable medium or media can be transportable, such that the program or programs stored thereon can be loaded onto one or more different computers or other processors to implement various aspects of the present disclosure as discussed above.

The terms "program" or "software" or "instructions" are used herein in a generic sense to refer to any type of computer code or set of computer-executable instructions that can be employed to program a computer or other processor to implement various aspects of embodiments as discussed above. Additionally, it should be appreciated that according to one aspect, one or more computer programs that when executed perform methods of the present disclosure need not reside on a single computer or processor, but may be distributed in a modular fashion amongst a number of different computers or processors to implement various aspects of the present disclosure.

Computer-executable instructions may be in many forms, such as program modules, executed by one or more computers or other devices. Generally, program modules include routines, programs, objects, components, data structures, etc. that perform particular tasks or implement particular abstract data types. Typically the functionality of the program modules may be combined or distributed as desired in various embodiments.

Also, data structures may be stored in computer-readable media in any suitable form. For simplicity of illustration, data structures may be shown to have fields that are related through location in the data structure. Such relationships may likewise be achieved by assigning storage for the fields with locations in a computer-readable medium that convey relationship between the fields. However, any suitable mechanism may be used to establish a relationship between information in fields of a data structure, including through the use of pointers, tags or other mechanisms that establish relationship between data elements.

All definitions, as defined and used herein, should be understood to control over dictionary definitions, definitions in documents incorporated by reference, and/or ordinary meanings of the defined terms.

"Logic", as used herein, includes but is not limited to hardware, firmware, software, and/or combinations of each to perform a function(s) or an action(s), and/or to cause a function or action from another logic, method, and/or system. For example, based on a desired application or needs, logic may include a software controlled microprocessor, discrete logic like a processor (e.g., microprocessor), an application specific integrated circuit (ASIC), a programmed logic device, a memory device containing instructions, an electric device having a memory, or the like. Logic may include one or more gates, combinations of gates, or other circuit components. Logic may also be fully embodied as software. Where multiple logics are described, it may be possible to incorporate the multiple logics into one physical logic. Similarly, where a single logic is described, it may be possible to distribute that single logic between multiple physical logics.

Furthermore, the logic(s) presented herein for accomplishing various methods of this system may be directed towards improvements in existing computer-centric or internet-centric technology that may not have previous analog versions. The logic(s) may provide specific functionality directly related to structure that addresses and resolves some problems identified herein. The logic(s) may also provide significantly more advantages to solve these problems by providing an exemplary inventive concept as specific logic structure and concordant functionality of the method and system. Furthermore, the logic(s) may also provide specific computer implemented rules that improve on existing technological processes. The logic(s) provided herein extends beyond merely gathering data, analyzing the information, and displaying the results. Further, portions or all of the present disclosure may rely on underlying equations that are derived from the specific arrangement of the equipment or components as recited herein. Thus, portions of the present disclosure as it relates to the specific arrangement of the components are not directed to abstract ideas. Furthermore, the present disclosure and the appended claims present teachings that involve more than performance of well-understood, routine, and conventional activities previously known to the industry. In some of the method or process of the present disclosure, which may incorporate some aspects of natural phenomenon, the process or method steps are additional features that are new and useful.

The articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "element A and/or element B", when used in conjunction with open-ended language such as "comprising" can refer, in one embodiment, to element A only (optionally including elements other than element B); in another embodiment, to element B only (optionally including elements other than element A); in yet another embodiment, to both element A and element B (optionally including other elements); etc. As used herein in the specification and in the claims, "or" should be understood to have the same meaning as "and/or" as defined above. For example, when separating articles in a list, "or" or "and/or" shall be interpreted as being inclusive, i.e., the inclusion of at least one, but also including more than one, of a number or list of elements, and, optionally, additional unlisted articles. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "above", "behind", "in front of", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal", "lateral", "transverse", "longitudinal", and the like are used herein for the purpose of explanation only unless specifically indicated otherwise.

Although the terms "first" and "second" may be used herein to describe various features/elements, these features/elements should not be limited by these terms, unless the context indicates otherwise. These terms may be used to distinguish one feature/element from another feature/element. Thus, a first feature/element discussed herein could be termed a second feature/element, and similarly, a second feature/element discussed herein could be termed a first feature/element without departing from the teachings of the present invention.

An embodiment is an implementation or example of the present disclosure. Reference in the specification to "an embodiment," "one embodiment," "some embodiments," "one particular embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical range recited herein is intended to include all sub-ranges subsumed therein.

Additionally, any method of performing the present disclosure may occur in a sequence different than those described herein. Accordingly, no sequence of the method should be read as a limitation unless explicitly stated. It is recognizable that performing some of the steps of the method in a different order could achieve a similar result.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively.

In the foregoing description, certain terms have been used for brevity, clarity, and understanding. No unnecessary limitations are to be implied therefrom beyond the requirement of the prior art because such terms are used for descriptive purposes and are intended to be broadly construed.

Moreover, the description and illustration of various embodiments of the disclosure are examples and the disclosure is not limited to the exact details shown or described.

What is claimed:

1. A method of custom packaging a plurality of articles, said method comprising:

providing a system for automatically custom packaging each individual article of the plurality of articles;

feeding a packaging material from a packaging material source of the system to a packaging station of the system, wherein the packaging material is formed of at least a first layer of material and a second layer of material laminated together;

moving the plurality of articles along a first conveyor of the system and towards the packaging station;

scanning an individual article of the plurality of articles with a detecting device of the system prior to the individual article reaching the packaging station;

sending scanned data with respect to the individual article from the detecting device to a processor of the system;

calculating, with programming provided in the processor, a length of the packaging material required to package the individual article;

moving the packaging material from a unexpanded condition to an expanded condition to form expanded packaging material, wherein during expanding, the first layer expands in a horizontal direction and the second layer expands in a vertical direction in response to the first layer being expanded in the horizontal direction;

forming, with a former of the system in the packaging station, a package section from the expanded packaging material;

depositing the individual article into the package section; and sealing, with a sealing mechanism of the system, the package section around the individual article to form a final package.

2. The method according to claim 1, wherein feeding the packaging material includes feeding pre-fabricated packaging material to the packaging station.

3. The method according to claim 1, wherein feeding the packaging material includes assembling packaging material in situ by feeding the first layer of material and the second layer of material into an assembly and laminating mechanism during a packaging operation and assembling the first layer and the second layer into the packaging material which is subsequently fed to the packaging station.

4. The method according to claim 1, wherein feeding the packaging material includes feeding fully-recyclable packing material to the packaging station.

5. The method according to claim 1, wherein moving the packaging material from the unexpanded condition to the expanded condition comprises applying tension to the packaging material.

6. The method according to claim 5, further comprising expanding the first layer of the packaging material in a horizontal plane in response to applying tension to the packaging material.

7. The method according to claim 6, further comprising expanding the second layer of the packaging material in a vertical plane in response to expanding the first layer in the horizontal plane.

8. The method according to claim 7 further comprising: controlling, with the processor, the tension to be applied to the packaging material to expand the first layer of the packaging material.

9. The method according to claim 7 further comprising: perforating the first layer of the packaging material.

10. The method according to claim 9 wherein the expanding of the second layer of the packaging material leaves the perforating of the first layer uncovered.

11. The method according to claim 1, further comprising cutting the final package from a remaining length of the packaging material moving towards the packaging station.

12. The method according to claim 11 wherein the cutting the final package from the remaining length of the packaging material is performed with a cutting device of the system.

13. The method according to claim 1, further comprising repositioning or reorienting the individual article prior to the individual article reaching the packaging station.

14. The method according to claim 1, further comprising forming the final package in real time, wherein the real time is time taken for the individual article to travel along the first conveyor, be scanned by the detecting device, forming of the package section in the packaging material, depositing the individual article into the formed package section, and sealing the package section around the individual article.

15. The method according to claim 1 further comprising: applying a shipping label to the final package based on the scanned data of the individual article.

16. The method according to claim 15 further comprising: inserting a packaging slip into the package section with the depositing of the individual article based on the scanned data of the individual article prior to sealing the package section.

17. The method according to claim 15 further comprising: inserting a pre-printed packaging slip into package section with the depositing of the individual article prior to sealing the packaging section.

18. The method according to claim 1 further comprising: conveying the final package along a second conveyer from the packaging station to a remote location for shipping to a customer.

19. The method according to claim 1 further comprising: scanning the deposited individual article and the package section around the individual article to verify that the individual article is not obstructing the sealing.

20. The method according to claim 1 wherein the moving the packaging material from the unexpanded condition to the expanded condition to form expanded packaging material is performed with a tensioning device of the system.

* * * * *